US009333755B2

(12) United States Patent
Takagiwa

(10) Patent No.: US 9,333,755 B2
(45) Date of Patent: May 10, 2016

(54) CARTRIDGE CASE

(71) Applicant: BROTHER KOGYO KABUSHIKI KAISHA, Nagoya-shi, Aichi (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/638,804

(22) Filed: Mar. 4, 2015

(65) Prior Publication Data

US 2015/0273844 A1 Oct. 1, 2015

(30) Foreign Application Priority Data

Mar. 31, 2014 (JP) ..... 2014-074601

(51) Int. Cl.
*B41J 2/175* (2006.01)
*B41J 29/02* (2006.01)

(52) U.S. Cl.
CPC ..... *B41J 2/17513* (2013.01); *B41J 2/1752* (2013.01); *B41J 2/17523* (2013.01); *B41J 2/17553* (2013.01); *B41J 29/02* (2013.01); *B41J 2002/17516* (2013.01)

(58) Field of Classification Search
CPC .... B41J 2/175; B41J 2/17503; B41J 2/17513; B41J 2002/17516; B41J 2002/17586
USPC ..... 347/85, 86
See application file for complete search history.

(56) References Cited

U.S. PATENT DOCUMENTS 3,874,934 A 4/1975 Zangrando
4,765,512 A 8/1988 Bull, Jr.
5,560,518 A 10/1996 Catterall et al.
6,315,402 B1 11/2001 Kawase
6,331,053 B1 * 12/2001 Seccombe ..... B41J 2/17513 222/99
2009/0289972 A1 * 11/2009 Iino ..... B41J 2/175 347/7

(Continued)

FOREIGN PATENT DOCUMENTS

JP H09-300583 A 11/1997
JP 2002-361882 A 12/2002

(Continued)

OTHER PUBLICATIONS

Sugiyama, Toshiro, MachineTranslationofJP2010-105195A, May 13, 2010.*

(Continued)

*Primary Examiner* — Geoffrey Mruk
*Assistant Examiner* — Scott A Richmond
(74) *Attorney, Agent, or Firm* — Fox Rothschild LLP

(57) ABSTRACT

A shaft portion moves in a first direction in accordance with a liquid storage amount in a bag by taking up an elastic member which generates a restoring force in the first direction. The shaft portion extends in a third direction orthogonal to the first direction and has a protruding end portion provided at an end in the third direction. An arm portion extending in the first direction is arranged in a case main body and moves along a fourth direction orthogonal to the first and the third directions. A contact portion of the arm portion is arranged on a movement path of the protruding end portion such that the contact portion comes into contact with the protruding end portion that moves in the first direction. A display portion of the arm portion moves along the fourth direction in accordance with the movement of the arm portion.

21 Claims, 31 Drawing Sheets

(56) References Cited

U.S. PATENT DOCUMENTS

| | | | |
|---|---|---|---|
| 2010/0225716 | A1 | 9/2010 | Hayakawa et al. |
| 2012/0327162 | A1 | 12/2012 | Mizuno |
| 2015/0273841 | A1 | 10/2015 | Takagiwa |
| 2015/0273843 | A1 | 10/2015 | Takagiwa |

FOREIGN PATENT DOCUMENTS

| | | | | |
|---|---|---|---|---|
| JP | 2010-105195 | A | | 5/2010 |
| JP | 2010105195 | A | * | 5/2010 |
| JP | 2013-006349 | A | | 1/2013 |

OTHER PUBLICATIONS

Office Action issued on Jan. 25, 2016 in the related U.S. Appl. No. 14/638,646.

U.S. Appl. No. 14/638,599, filed Mar. 4, 2015, Cartridge Case.

U.S. Appl. No. 14/638,646, filed Mar. 4, 2015, Cartridge Case.

* cited by examiner

CARTRIDGE CASE

CROSS-REFERENCE TO RELATED APPLICATION

This application claims priority to Japanese Patent Application No. 2014-074601 filed on Mar. 31, 2014, the disclosure of which is herein incorporated by reference in its entirety.

BACKGROUND

The present disclosure relates to a cartridge case that supports a bag storing a liquid.

In related art, a cartridge is known that houses a liquid storage bag storing a liquid. For example, a known ink cartridge is provided with an ink pack, a housing and a detection plate. The ink pack is provided with a reservoir portion that stores ink, which is the liquid. The housing internally houses the ink pack. The detection plate is supported by a support mechanism provided in the housing such that the detection plate can rotate in accordance with a thickness of the reservoir portion. The detection plate is provided with a display portion. When there is a lot of ink in the reservoir portion, the thickness of the reservoir portion is large and the display portion of the detection plate is in a position to the left side. When the ink inside the reservoir portion decreases, the thickness of the reservoir portion becomes small and the display portion of the detection plate moves to the right side. In this way, the ink cartridge can display a remaining amount of the ink inside the reservoir portion, using the position of the display portion.

SUMMARY

However, when the ink cartridge is an ink pack having a structure in which the liquid inside the reservoir portion is pressed out from a plug by taking up the reservoir portion, even if the remaining amount of ink decreases, the thickness of the reservoir portion does not become thinner. As a result, in the known detection plate, it is not possible to display the remaining amount of ink in the reservoir portion.

Various exemplary embodiments of the general principles described herein provide a cartridge case that is capable of winding a bag storing a liquid and is also capable of displaying a remaining amount of the liquid inside the bag.

Exemplary embodiments herein provide a cartridge case that supports a bag storing a liquid. The cartridge case is provided with a case main body, a shaft portion, an arm portion, a contact portion and a display portion.

The case main body includes a first side wall and a second side wall that extend in a first direction. The first side wall and the second side wall are arranged to face each other. The case main body has an end open portion. The end open portion is an open portion that is formed between end portions in the first direction of each of the first side wall and the second side wall. The shaft portion is arranged to take up an elastic member from an end portion on a second direction side of the elastic member and to move in the first direction in accordance with a liquid storage amount in the bag, the elastic member generating a restoring force in the first direction by being extended in the second direction. The second direction is a direction opposite to the first direction. The shaft portion extends in a third direction. The third direction is a direction in which the first side wall and the second side wall face each other. The third direction is orthogonal to the first direction. The shaft portion has a pair of protruding end portions that respectively protrude in the third direction from both ends in the third direction of the shaft portion.

The arm portion extends in the first direction. The arm portion is arranged inside the case main body on the first direction side and on an end portion on the first side wall side. The arm portion is supported by the first side wall such that the arm portion can move along a fourth direction. The fourth direction is a direction that is orthogonal to the first direction and orthogonal to the third direction. The contact portion is provided on the arm portion. The contact portion is arranged on a movement path of the protruding end portion such that the contact portion comes into contact with the protruding end portion that moves in the first direction. The display portion is provided in a fixed manner with respect to an end portion in the first direction of the arm portion, such that the display portion moves along the fourth direction in accordance with the movement of the arm portion.

BRIEF DESCRIPTION OF THE DRAWINGS

Embodiments will be described below in detail with reference to the accompanying drawings in which.

DETAILED DESCRIPTION

Figure 1:
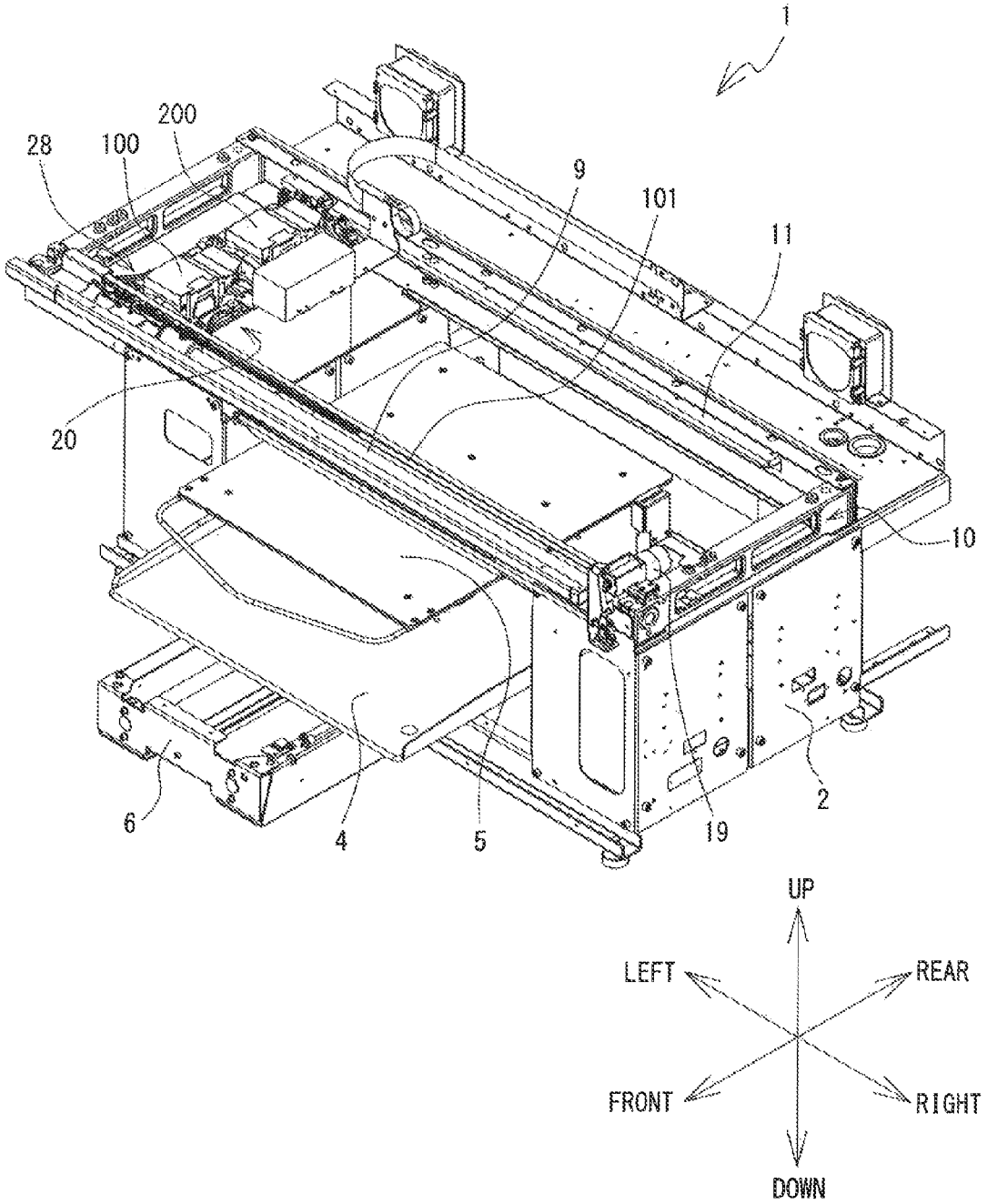
FIG. 1 is a perspective view of a printer.
Figure 2:
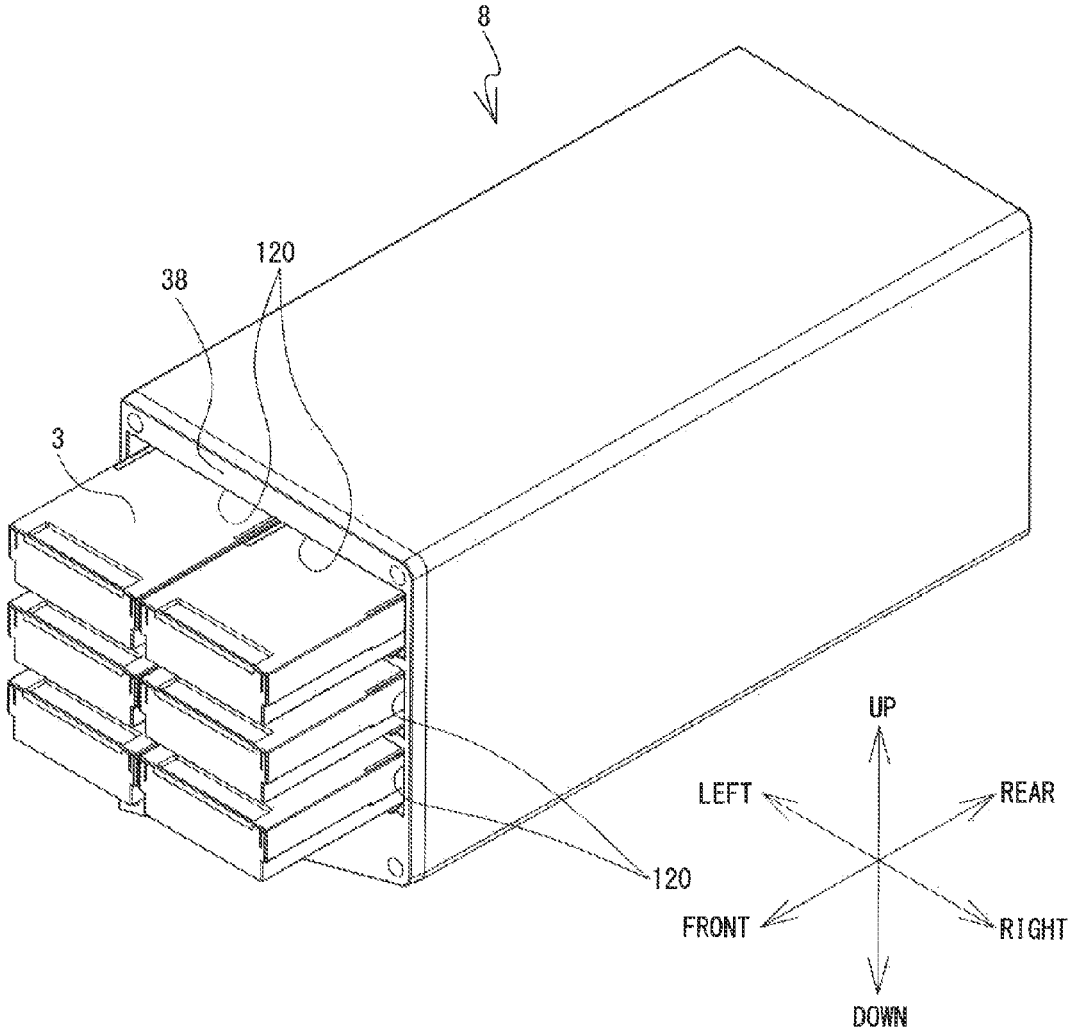
FIG. 2 is a perspective view of a cartridge mounting portion.

An up-down direction, a left-right direction and a front-rear direction indicated by arrows in FIG. 1 respectively denote an up-down direction, a left-right direction and a front-rear direction of a printer 1. Arrows in FIG. 2 are the same.

As shown in FIG. 1, the printer 1 is an inkjet printer. The printer 1 discharges a liquid ink onto a print medium (not shown in the drawings). In the present embodiment, the print medium is a fabric, such as a T-shirt or the like. The print medium may be paper or the like. The printer 1 of the present embodiment can discharge five types of ink in a downward direction. The printer 1 can perform color printing on a fabric. The five types of ink are white (W), black (K), yellow (Y), cyan (C) and magenta (M).

The printer 1 is mainly provided with a housing 2, a platen drive mechanism 6, a platen 5, a tray 4, a frame body 10, a guide shaft 9, a rail 11, a carriage 20, a support portion (not shown in the drawings), head units 100 and 200, a drive belt 101 and a drive motor 19.

The housing 2 is a substantially cuboid shape that extends in the left-right direction. An operating portion (not shown in the drawings) is provided on a right front portion of the housing 2. The operating portion is provided with a display and operating buttons. The display displays various types of information. A user operates the operating buttons when inputting commands relating to various operations of the printer 1.

A pair of guide rails (not shown in the drawings) are provided inside the platen drive mechanism 6. The pair of guide rails extend in the front-rear direction. The pair of guide rails support the platen 5 and the tray 4. The platen 5 and the tray 4 can move along the pair of guide rails. A driving source of the platen drive mechanism 6 is a motor (not shown in the drawings). The motor is positioned on a rear end portion of the platen drive mechanism 6. The platen 5 and the tray 4 move along the pair of guide rails due to a driving force of the motor. The platen 5 is a substantially rectangular shaped plate that extends in the front-rear direction. The platen 5 is positioned below the frame body 10. The fabric is placed on an upper surface of the platen 5. The tray 4 is a rectangular shape. The tray 4 is positioned below the platen 5. When the user places a T-shirt on the platen 5, the tray 4 holds the sleeves of the T-shirt. Thus, the sleeves do not fall inside the housing 2.

The frame body 10 is a substantially rectangular shaped frame. The frame body 10 is positioned above the housing 2. The guide shaft 9 and the rail 11 are provided inside the frame body 10. The frame body 10 supports the guide shaft 9 and the rail 11. The guide shaft 9 is a shaft member that extends in the left-right direction. The rail 11 is a rod-shaped member that extends in the left-right direction. The rail 11 faces the guide shaft 9. The guide shaft 9 and the rail 11 are mutually separated in the front-rear direction.

The guide shaft 9 and the rail 11 support the carriage 20. The carriage 20 can move in the left-right direction. The head units 100 and 200 are mounted on the carriage 20. Bottom surfaces of each of the head units 100 and 200 have head portions (not shown in the drawings). The head portions are provided with a plurality of fine nozzles. The head portions discharge droplets of ink in a downward direction from the nozzles as a result of operation of a piezoelectric element.

The flexible drive belt 101 is a belt shape that is stretched along the inside of the frame body 10 in the left-right direction. The drive belt 101 is made of synthetic resin. The drive motor 19 is positioned inside the frame body 10 and to the front right side. The drive motor 19 is positioned between the guide shaft 9 and the rail 11 in the front-rear direction. The drive motor 19, which is able to rotate in the positive and reverse directions, is coupled to the carriage 20 via the drive belt 101. An overview of a printing operation by the printer 1 on the fabric is as follows. When the drive motor 19 drives the drive belt 101, the carriage 20 reciprocates in the left-right direction and the head portions of the head units 100 and 200 thus reciprocate in the left-right direction. The platen 5 feeds the fabric in the front-rear direction. The feed direction of the fabric by the platen 5 is the front-rear direction. The ink is discharged by the head portions that are reciprocating in the left-right direction.

Figure 3:
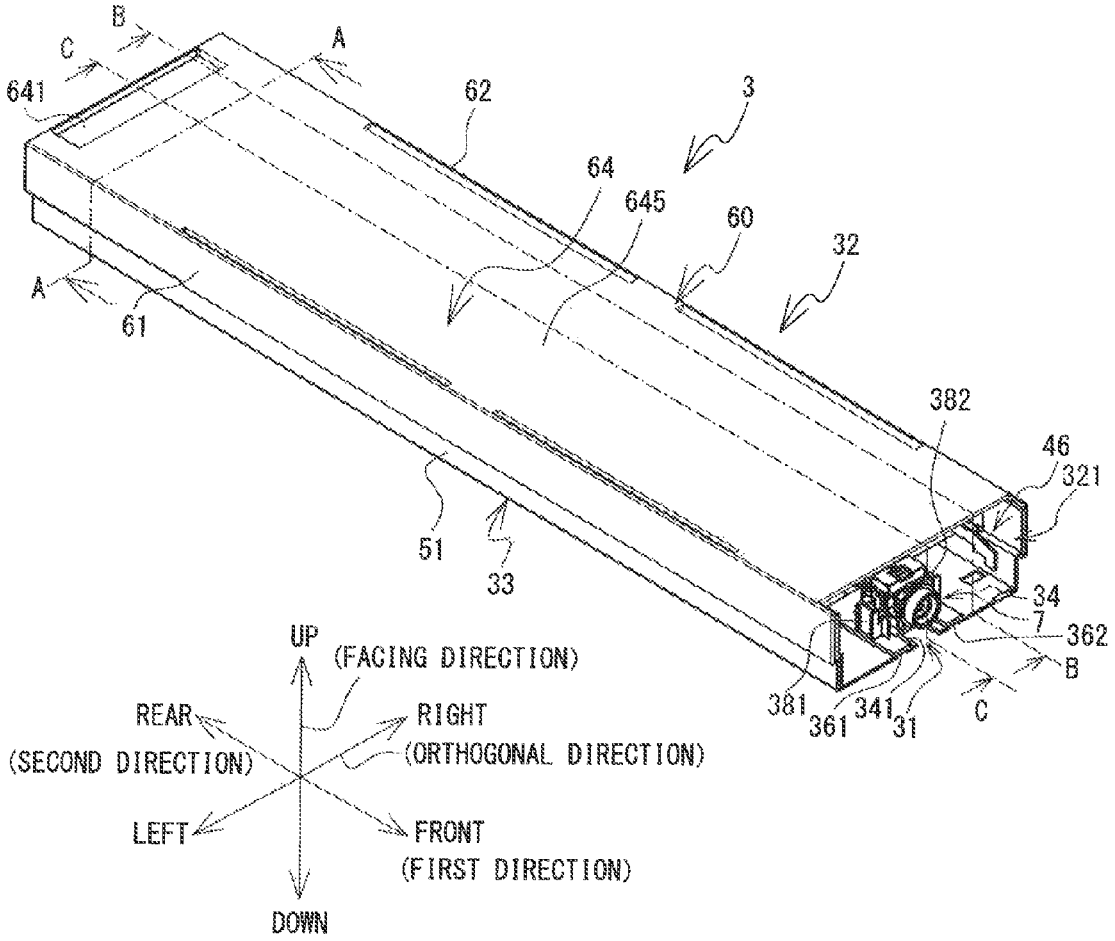
FIG. 3 is a perspective view of a cartridge.

The cartridge mounting portion 8 shown in FIG. 2 is adjacent to the housing 2, on the outside and to the right of the housing 2. A plurality of cartridges 3 (six in the present embodiment) can be mounted in the cartridge mounting portion 8. The cartridges 3 that are mounted in the cartridge mounting portion 8 supply ink to the head portions of the head units 100 and 200. A frame portion 38 on a front portion of the cartridge mounting portion 8 has a plurality of open portions 120. The cartridge 3 can be inserted into and removed from the open portion 120. The frame portion 38 has three columns of the open portions 120 in the up-down direction and two rows of the open portions 120 in the left-right direction. As shown in FIG. 3, the cartridge 3 houses a liquid storage body 31. The liquid storage body 31 has a plug 7. The plug 7 has a rubber plug (not shown in the drawings). When the cartridge 3 is mounted in the cartridge mounting portion 8, a hollow needle (not shown in the drawings) that leads out the liquid from the liquid storage body 31 pierces the rubber plug (not shown in the drawings).

Figure 4:
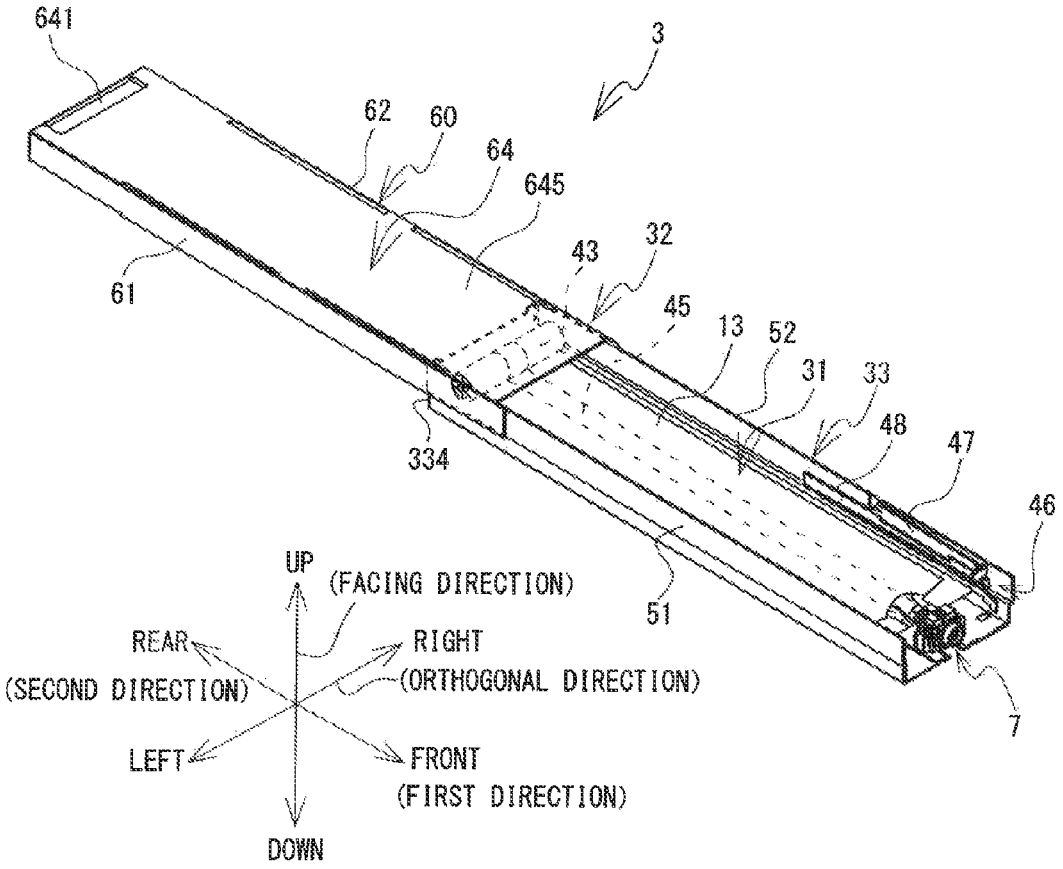
FIG. 4 is a perspective view of the cartridge.

The cartridge 3 will be explained in detail with reference to FIG. 3 to FIG. 24D. In the following explanation, the up-down direction, the left-right direction and the front-rear direction indicated by arrows shown in FIG. 3 respectively denote the up-down direction, the left-right direction and the front-rear direction of the cartridge 3. For ease of explanation, the left-right direction and the front-rear direction of the cartridge 3 shown in FIG. 3 are changed from those of the printer 1 shown in FIG. 2. The direction indicating arrows in FIG. 4 are the same as those shown in FIG. 3. The direction indicating arrows shown in FIG. 5 onward are adjusted such that they match the arrows shown in FIG. 3. As shown in FIG. 3 and FIG. 4, the cartridge 3 is provided with the liquid storage body 31 and a case 32. The case 32 houses the liquid storage body 31.

Figure 5:
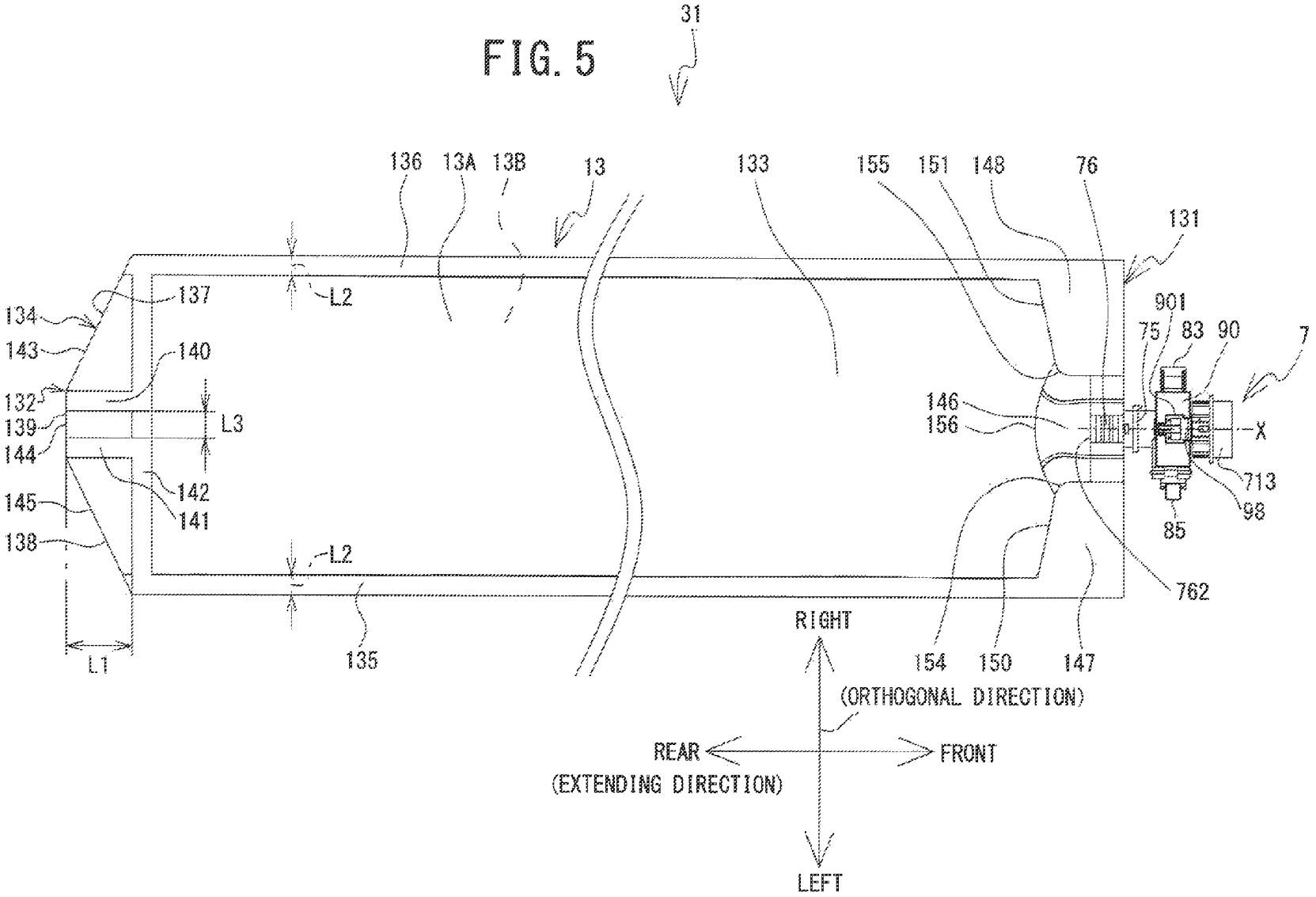
FIG. 5 is a plan view of a liquid storage body.
Figure 6:
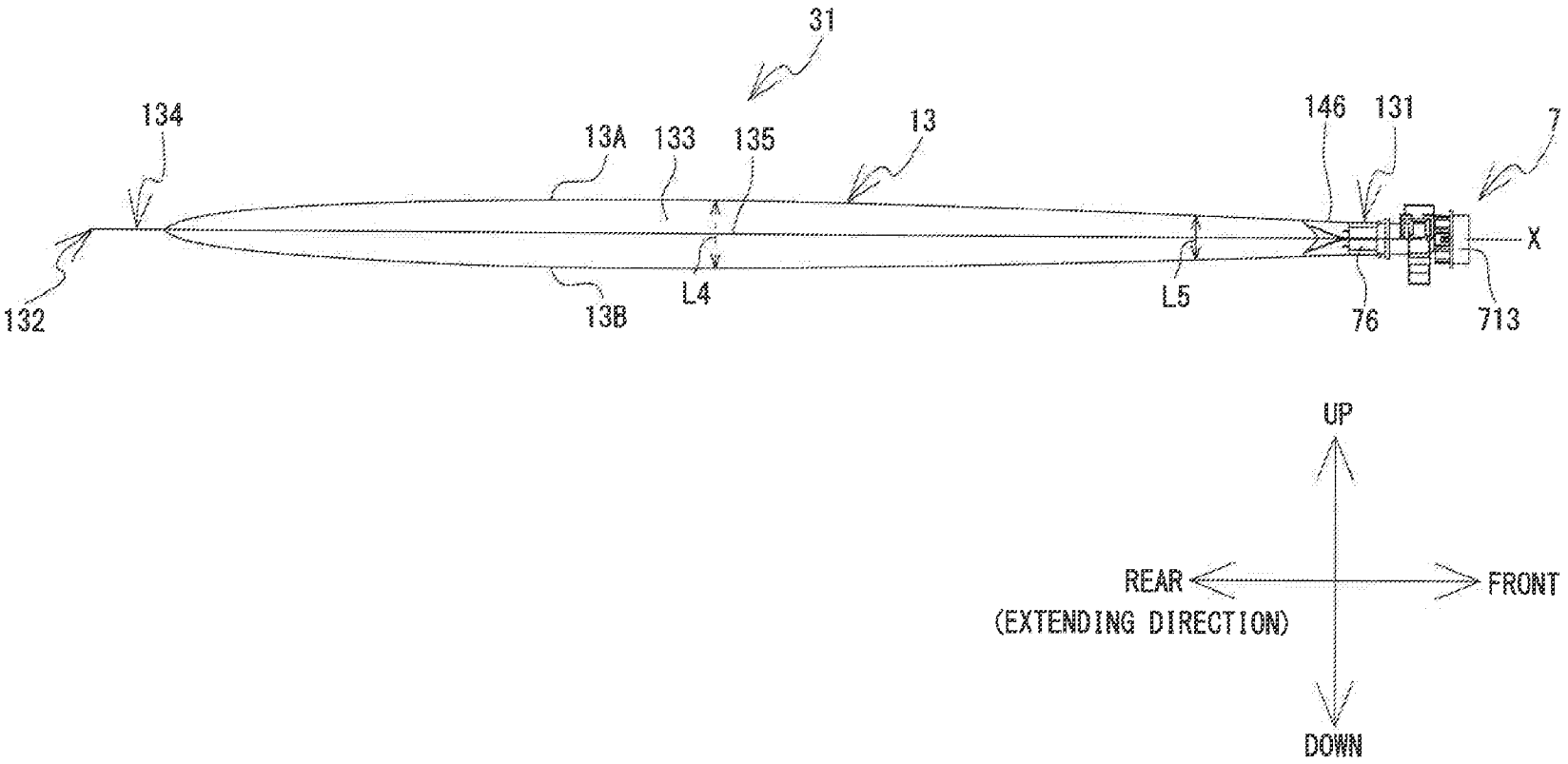
FIG. 6 is a left side view of the liquid storage body.

As shown in FIG. 4 and FIG. 5, the liquid storage body 31 is provided with a liquid storage bag 13 and the plug 7. As shown in FIG. 5 and FIG. 6, the liquid storage bag 13 is a bag shaped container. The liquid storage bag 13 is provided with two flexible sheets 13A and 13B that are made of synthetic resin and that have a rectangular shape. The sheets 13A and 13B are overlapped with each other and are connected by their edge portions being thermally welded. The liquid storage bag 13 extends in the front-rear direction. In the following explanation, the front end portion of the liquid storage bag 13 is referred to a first end portion 131 and the rear end portion of the liquid storage bag 13 that is opposite to the first end portion 131 is referred to as a second end portion 132. The rearward direction from the first end portion 131 toward the second end portion 132 is also referred to as an "extending direction." A surface of the sheet 13A or 13B is also referred to as a "sheet surface." The left-right direction that is orthogonal to the extending direction and is generally parallel to the sheet surface of the liquid storage bag 13 in which liquid is not stored is also referred to as an "orthogonal direction" or a "third direction."

The liquid storage bag 13 will be explained in detail. As shown in FIG. 5, the liquid storage bag 13 is provided with a liquid storage portion 133 and an extension portion 134. The liquid storage portion 133 includes the first end portion 131 and extends toward the rear, which is the extending direction. The liquid storage portion 133 internally stores a liquid. Examples of the liquid include ink and a discharging agent. The discharging agent removes color from dyed fabric. The liquid of the present embodiment is ink.

The extension portion 134 is a portion which does not store the ink. The extension portion 134 is connected to the liquid storage portion 133 on the side of the second end portion 132. The extension portion 134 extends from the liquid storage portion 133 in the extending direction. At end portions of the liquid storage portion 133 in the orthogonal direction, portions of the two sheets 13A and 13B that are connected to each other by the thermal welding are referred to as edge portions 135 and 136. At an end portion of the liquid storage portion 133 in the extending direction, a portion of the two sheets 13A and 13B that are connected to each other by the thermal welding in the orthogonal direction is referred to as a rear edge portion 142. The edge portions 135 and 136 extend as far as the extension portion 134. A length L1 of the extension portion 134 in the extending direction is longer than a length L2 of the edge portions 135 and 136 in the orthogonal direction.

The extension portion 134 is provided with tapered portions 137 and 138, first connected portions 140 and 141 and open portions 143, 144 and 145. The tapered portions 137 and 138 are portions that shorten the length of the extension portion 134 in the orthogonal direction such that the extension portion 134 tapers toward the extending direction. An end edge of the extension portion 134 in the extending direction is parallel to the orthogonal direction. The end edge is positioned in a central portion of the extension portion 134 in the orthogonal direction. Therefore, the end edge is hereinafter referred to as a "central portion 139."

The first connected portions 140 and 141 are portions of the extension portion 134 at which the two sheets 13A and 13B are thermally welded to each other. The first connected portions 140 and 141 are positioned further to the inside, in the orthogonal direction, than the edge portions 135 and 136. The first connected portion 140 extends in the extending direction from the rear edge portion 142 and reaches a right end portion of the central portion 139. The first connected portion 141 extends in the extending direction from the rear edge portion 142 and reaches a left end portion of the central portion 139. An inner position from both the edge portion 135 and the edge portion 136 is included in a rear-side area from a rear end of the edge portions 135 and 136 and a front-side area from a front end of the edge portions 135 and 136. The length of the extension portion 134 in the extending direction is referred to as the length L1. An interval in the orthogonal direction between the first connected portions 140 and 141 is referred to as a length L3. L3 is smaller than L1.

The open portions 143, 144 and 145 are provided on an end portion on the extending direction side of the extension portion 134. The open portions 143, 144 and 145 are provided between the sheets 13A and 13B. The open portions 143, 144 and 145 are portions on the end portion on the extending direction side of the extension portion 134 at which the sheets 13A and 13B are not thermally welded to each other. The open portion 143 is provided in the tapered portion 137. The open portion 144 is provided in the central portion 139 and is positioned between the first connected portion 140 and the first connected portion 141. The open portion 145 is provided in the tapered portion 138.

An insertion portion 76 of the plug 7 is provided between the sheets 13A and 13B at the first end portion 131. A curved area 146 is provided in the first end portion 131. In the curved area 146, the sheets 13A and 13B are curved in a direction to separate from each other (in the up-down direction) along the insertion portion 76. The curved area 146 extends further in the extending direction than the insertion portion 76.

Second connected portions 147 and 148, at which the sheets 13A and 13B are thermally welded to each other, are provided in the first end portion 131. The second connected portions 147 and 148 are positioned further to the outside, in the orthogonal direction, than the insertion portion 76. In other words, the insertion portion 76 is provided between the second connected portions 147 and 148 in the orthogonal direction. The second connected portions 147 and 148 have a substantially rectangular shape. The second connected portions 147 and 148 are provided, respectively, with corner portions 154 and 155. The corner portions 154 and 155 are positioned on the inside, in the orthogonal direction, of the edge portions 135 and 136 of the liquid storage bag 13 and further to the rear side with respect to the extending direction than the insertion portion 76. The corner portions 154 and 155 are rounded. In the extending direction, the corner portions 154 and 155 are positioned between an end portion 762 of the insertion portion 76 and an end portion 156 of the curved area 146. Sides of the second connected portions 147 and 148 on the extending direction side are referred to as a side 150 and a side 151, respectively. The side 150 is inclined such that the further the side 150 is separated from the side 151 in the orthogonal direction, the further to the extending direction side the side 150 is positioned. The same also applies to the side 151.

Figure 7:
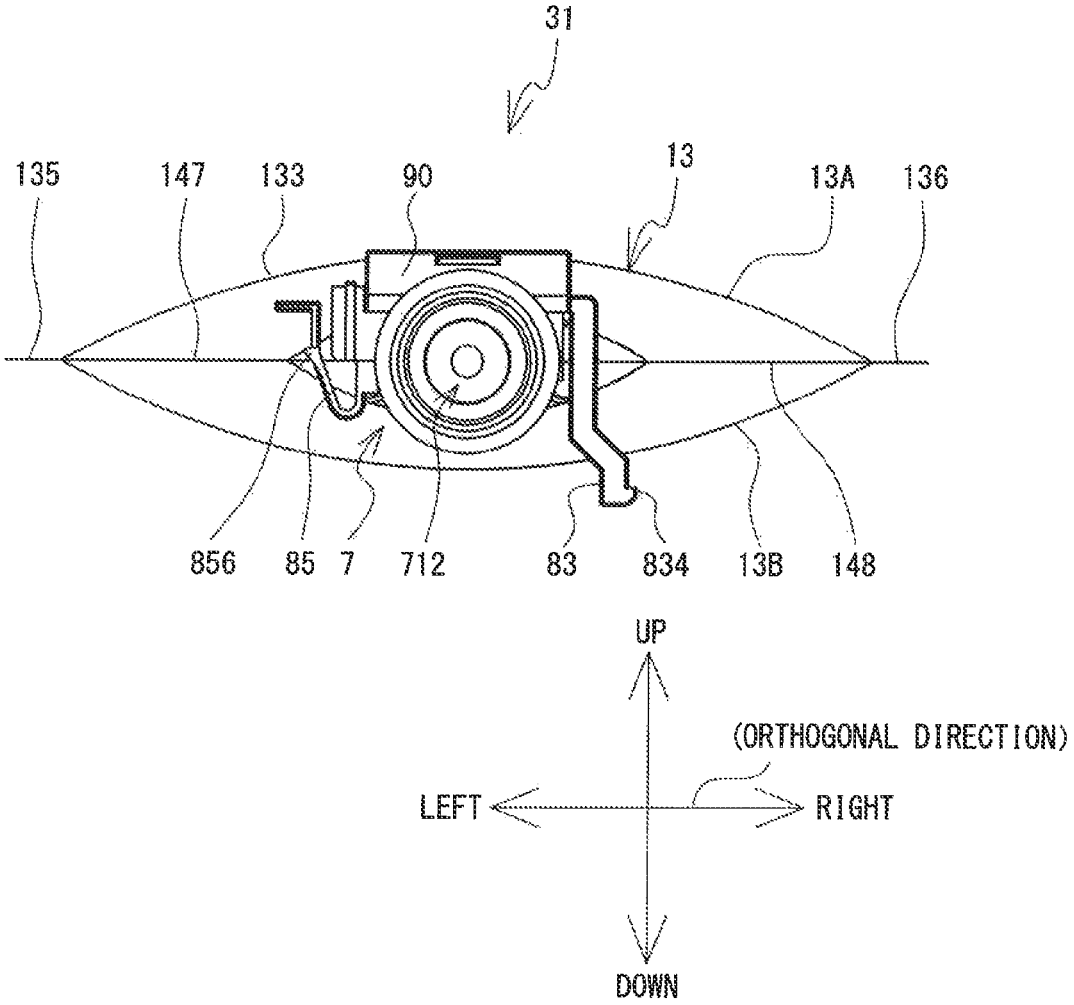
FIG. 7 is a front view of the liquid storage body.

The plug 7 will be explained. As shown in FIG. 5 and FIG. 6, the plug 7 is connected to the first end portion 131 of the liquid storage bag 13. The plug 7 extends in the front-rear direction, which is an X-axis line direction. The X-axis line direction is parallel to the extending direction. The plug 7 is provided with a leading end portion 713, a first plug protruding portion 83, a second plug protruding portion 85, a holder 90, an electric board 98 and the insertion portion 76. The leading end portion 713 on the front side of the plug 7 is a cylindrical shape that extends in the front-rear direction, which is the X-axis line direction. As shown in FIG. 7, the plug 7 has a hollow portion 712. The hollow portion 712 extends toward the rear from the center, in a front view, of the leading end portion 713. The hollow portion 712 causes the interior of the liquid storage portion 133 to communicate with the exterior of the plug 7. The rubber plug (not shown in the drawings) is provided in a part of the hollow portion 712 in the X-axis line direction. The rubber plug seals the hollow portion 712. Therefore, the ink inside the liquid storage portion 133 cannot leak out.

As shown in FIG. 5, the first plug protruding portion 83, the second plug protruding portion 85 and the holder 90 are provided to the rear of the leading end portion 713. As shown in FIG. 7, the first plug protruding portion 83 is positioned to the right of the plug 7. After extending downward from the plug 7, the first plug protruding portion 83 extends diagonally downward and to the right, and the lower end of the first plug protruding portion 83 extends downward. The lower end portion of the first plug protruding portion 83 is provided with a first engagement tab 834. The first engagement tab 834 protrudes to the right from the right side surface on the lower end portion of the first plug protruding portion 83.

The second plug protruding portion 85 is positioned to the left of the plug 7. The second plug protruding portion 85 is a curved plate shape, and deforms elastically in the rightward direction toward the plug 7. The second plug protruding portion 85 extends downward from the plug 7. Then, the second plug protruding portion 85 is curved at its lower end and extends upward. The second plug protruding portion 85 is provided with a second engagement tab 856. The second engagement tab 856 protrudes to the left from the left side surface of the second plug protruding portion 85.

Figure 9:
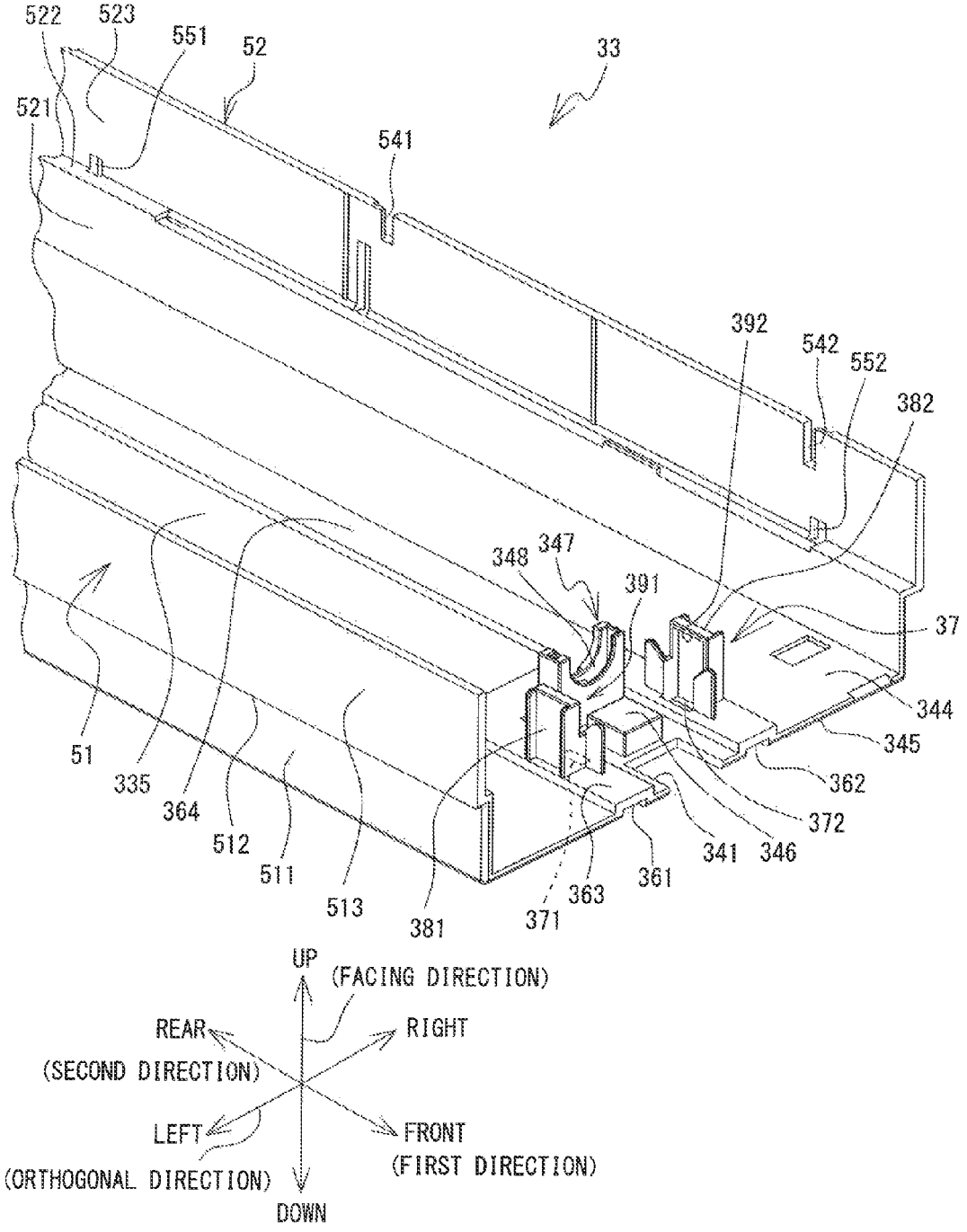
FIG. 9 is a perspective view of a front end portion of a first case.

As shown in FIG. 9, when the liquid storage body 31 is mounted in the case 32, the first plug protruding portion 83 engages with a first open portion 372 of the case 32, and the second plug protruding portion 85 engages with a second open portion 391 of the case 32. Details will be described later.

As shown in FIG. 5 and FIG. 7, the holder 90 is provided above the plug 7. A holder opening 901, which is an open portion, is provided in the top surface of the holder 90. The holder 90 holds the electric board 98. The holder opening 901 exposes the top surface of the electric board 98. A placement portion 75 is provided on the extending direction side of the holder 90. The placement portion 75 is a flange shape that protrudes to the outside from the periphery of the plug 7. It is not necessary for the holder 90 to hold the electric board 98.

The insertion portion 76 is an end portion in the extending direction of the plug 7. The insertion portion 76 is a cylindrical shape that extends in the extending direction. The insertion portion 76 is provided in a state of being arranged between the sheets 13A and 13B and thus being inserted inside the liquid storage portion 133. The sheets 13A and 13B are thermally welded with the insertion portion 76 sandwiched therebetween.

The case 32 will be explained. In the following explanation, the frontward direction is also referred as a "first direction." The rearward direction, which is the opposite direction to the first direction, is also referred to as a "second direction." The up-down direction, in which a first inner surface 344 and a second inner surface 644 that will be explained later aligned facing each other, is also referred to as a "facing direction" or a "fourth direction."

Figure 8:
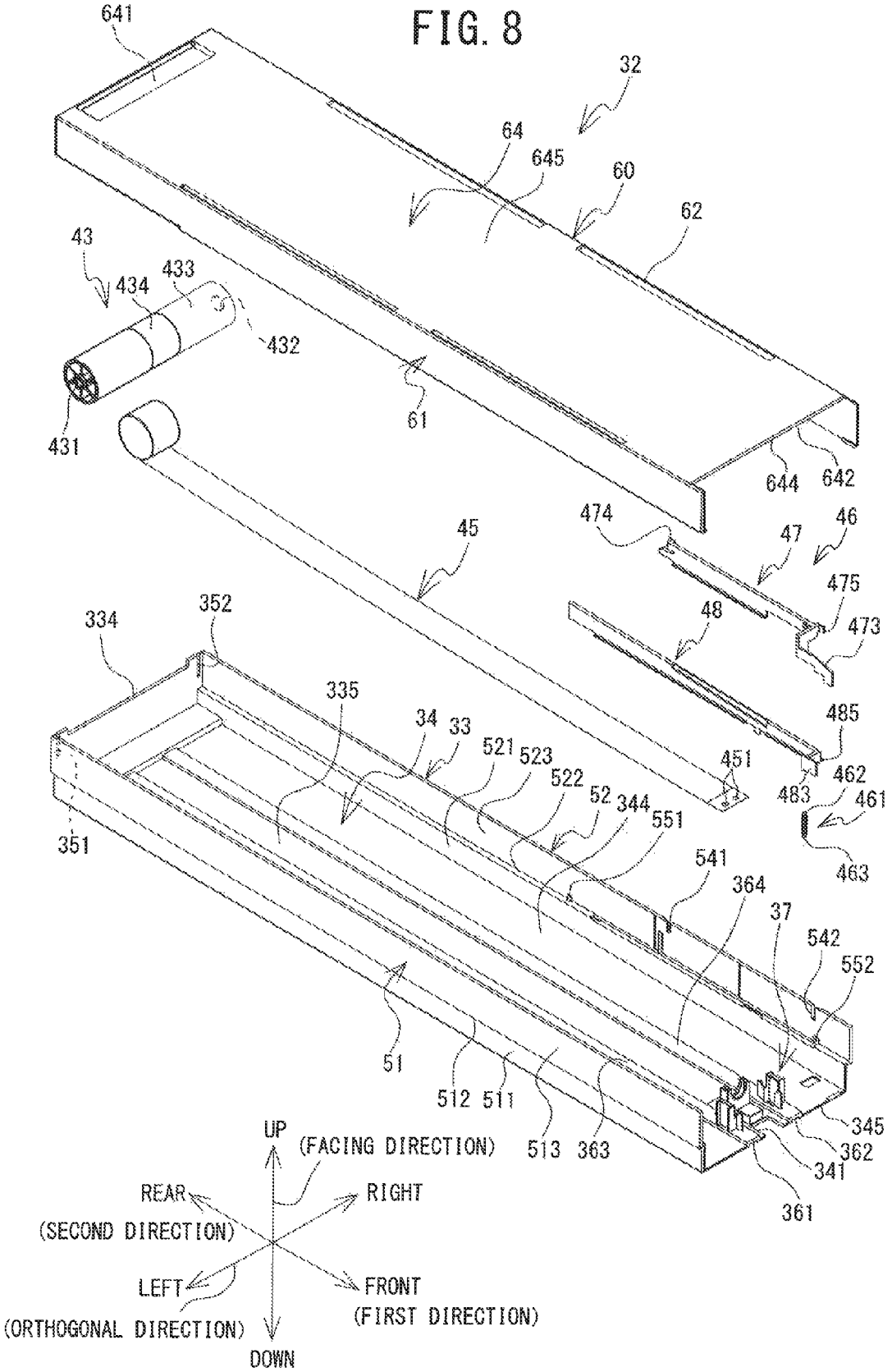
FIG. 8 is an exploded perspective view of a case.

As shown in FIG. 3, the case 32 has a box-shape which is long in the front-rear direction. The case 32 has an end open portion 321 which opens at an end portion of the case 32 on the first direction side. As shown in FIG. 3, FIG. 4 and FIG. 8, the case 32 includes a first case 33, a second case 60, a shaft portion 43, an elastic member 45 and a detection portion 46. The first case 33 supports the liquid storage body 31. The second case 60 is arranged above the first case 33. The second case 60 is capable of sliding with respect to the first case 33 in the first direction and the second direction (refer to FIG. 3 and FIG. 4).

Figure 10:
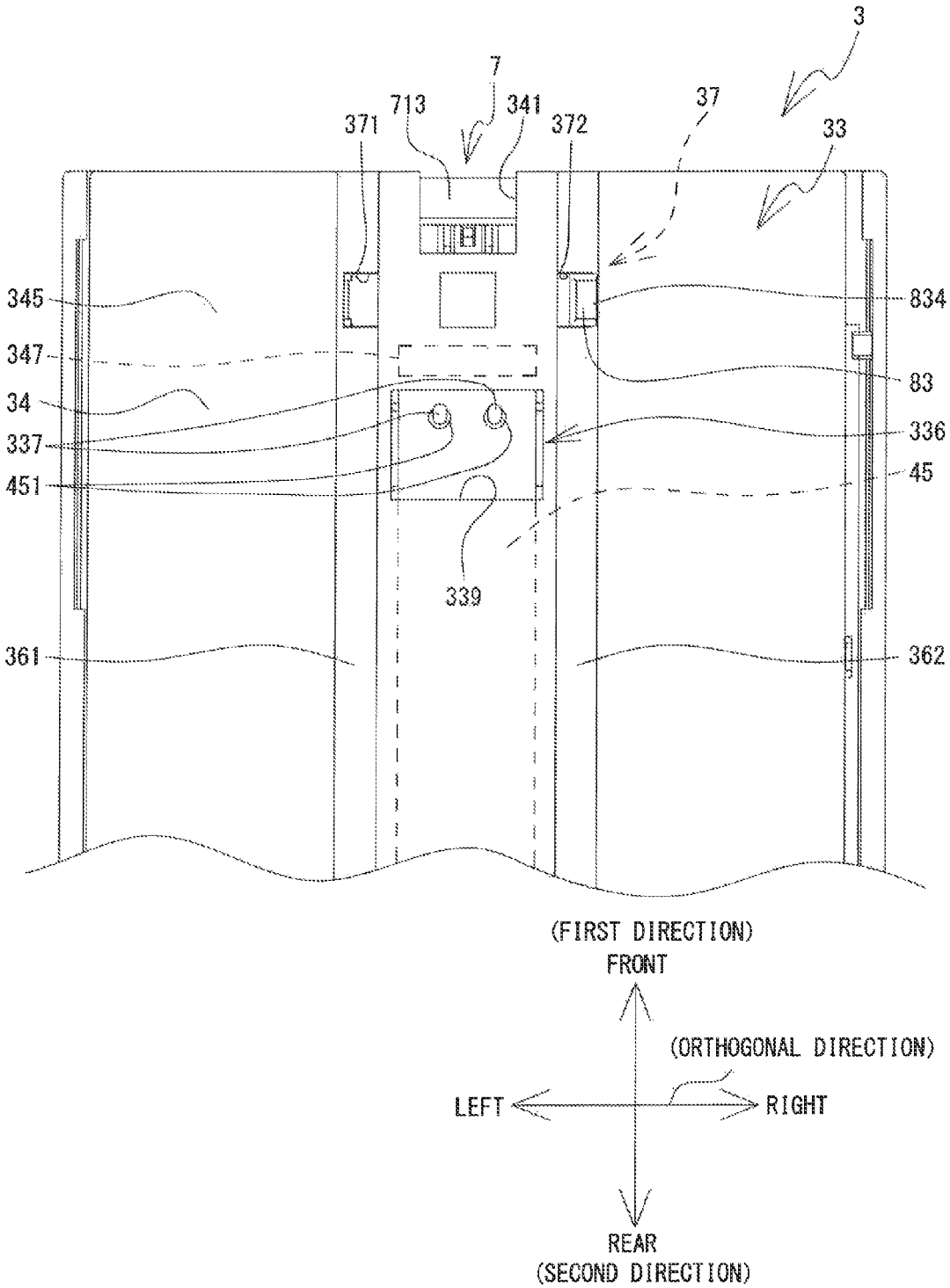
FIG. 10 is a bottom view of a front end portion of the cartridge.

As shown in FIG. 8, the first case 33 is provided with a support wall portion 34, a pair of side walls 51 and 52, a rear wall portion 334, a case recessed portion 335 and a mounting portion 336 (refer to FIG. 10). The support wall portion 34 is provided with the upper-side first inner surface 344 that extends in the first direction from the rear end side of a bottom portion of the first case 33, and with a first outer surface 345 that is on the opposite side to the first inner surface 344. The orthogonal direction is a direction that is parallel to the first inner surface 344 and that is orthogonal to the first direction. The pair of side walls 51 and 52 extend upward from the end portion in the orthogonal direction of the first inner surface 344. The rear wall portion 334 extends upward from the rear end portion of the first inner surface 344. The end portion in the orthogonal direction of the rear wall portion 334 is provided with slits 351 and 352 that extend downward from the upper end of the rear wall portion 334. When the second case 60 slides in the second direction with respect to the first case 33, protruding wall portions 65 and 66 (refer to FIG. 11, to be explained later) of the second case 60 pass through the inside of the slits 351 and 352. The end portion of the first case 33 on the first direction side is an open portion that does not have a wall portion.

As shown in FIG. 8 and FIG. 9, a recessed portion 341 that is recessed in a rectangular shape toward the second direction is provided in the center, in the left-right direction, of the end portion of the support wall portion 34 on the first direction side. The first outer surface 345 is provided with two groove portions 361 and 362 that are recessed in the upward direction. The groove portion 361 is provided to the left of the recessed portion 341, and extends from the front end of the support wall portion 34 to a front side of the rear end. The groove portion 362 is provided to the right of the recessed portion 341 and extends from the front end of the support wall portion 34 to the front side of the rear end. By providing the groove portions 361 and 362 in the first outer surface 345, protruding portions 363 and 364 that protrude upward are provided above the groove portions 361 and 362 in the first inner surface 344.

As shown in FIG. 9, a plug support portion 37 that supports the plug 7 is provided to the rear of the recessed portion 341. The plug support portion 37 includes a first open portion 371 and the first open portion 372, open wall portions 381 and 382, a first support portion 346 and a second support portion 347. Each of the first open portions 371 and 372 is formed in a rectangular shape in a plan view and penetrates the support wall portion 34 in the up-down direction, at a front portion of each of the groove portions 361 and 362, respectively (refer to FIG. 9 and FIG. 10). The open wall portions 381 and 382 extend upward from the protruding portions 363 and 364, respectively. The open wall portions 381 and 382 are respectively provided with the second open portion 391 and a second open portion 392, which have a rectangular shape in a side view and which are respectively provided on the inside of the open wall portions 381 and 382 in the orthogonal direction. The first open portion 371 is provided on the surface of the protruding portion 363 at a position which is enclosed with the open wall portions 381 and 382 in the orthogonal direction, wherein each of the open wall portions 381 and 382 forms the second open portion 391 and a second open portion 392, respectively. In the same manner, the first open portion 372 is provided on the surface of the protruding portion 364 at a position which is enclosed with the open wall portions 381 and 382 in the orthogonal direction.

When the liquid storage body 31 is mounted in the first case 33, the lower end of the first plug protruding portion 83 of the plug 7 protrudes from the first open portion 372 and is positioned in the groove portion 362. The first engagement tab 834 engages with the groove portion 362 (refer to FIG. 10). The second engagement tab 856 engages with the second open portion 391. The first open portions 371 and 372 are symmetrical with each other in the orthogonal direction with the first support portion 346 (to be explained later) as a center point between them. The second open portions 391 and 392 are symmetrical with each other in the orthogonal direction with the first support portion 346 as the center point between them. Thus, for example, when the plug 7 is a plug on which the first plug protruding portion 83 is arranged on the left side and the second plug protruding portion 85 is arranged on the right side, the lower end of the first plug protruding portion 83 protrudes from the first open portion 371 and is positioned in the groove portion 361. The first engagement tab 834 engages with the groove portion 361. The second engagement tab 856 engages with the second open portion 391.

As shown in FIG. 9, the first support portion 346 is positioned on the second direction side of the recessed portion 341 in the support wall portion 34 and is also positioned between the groove portion 361 and the groove portion 362. The first support portion 346 has a rectangular shape in a plan view and protrudes upward. The first support portion 346 supports the bottom surface of the plug 7. The second support portion 347 is provided on the second direction side of the first support portion 346. The second support portion 347 is a wall portion that extends upward from the support wall portion 34 and that is long in the left-right direction. The upper end of the second support portion 347 is recessed downward in a U shape in a front view. A recessed portion 348, which is recessed downward in the left-right direction, is provided in a center portion, in the front-rear direction, of the second support portion 347. When supporting the plug 7 on the plug support portion 37, an operator arranges the lower end of the placement portion 75 (refer to FIG. 5) of the plug 7 in the recessed portion 348 of the second support portion 347.

The case recessed portion 335 is positioned on the second direction side of the plug support portion 37. As shown in FIG. 8, the case recessed portion 335 is a recessed portion that is recessed downward between the protruding portions 363 and 364. The case recessed portion 335 extends in the first direction from a front side of the rear end portion of the support wall portion 34. The elastic member 45 is positioned on the inside of the case recessed portion 335. The case recessed portion 335 supports the elastic member 45. The elastic member 45 is a variable load plate spring.

As shown in FIG. 10, the mounting portion 336 is positioned on the second direction side of the plug support portion 37. The mounting portion 336 is a recessed portion that is formed to open downward and is provided inside of a projection which projects upward from the first inner surface 344 and the first outer surface 345 that is a bottom face of the first case 33. The mounting portion 336 is provided with two protrusions 337 that protrude downward from the first outer surface 345. The two protrusions 337 are aligned side by side in the orthogonal direction.

The case recessed portion 335 is provided with a mounting open portion 339. The mounting open portion 339 penetrates the support wall portion 34 in the up-down direction, on the second direction side of the mounting portion 336. The end portion on the first direction side of the elastic member 45 is provided with two round hole portions 451 that are aligned side by side in the orthogonal direction. When the elastic member 45 is arranged in the case recessed portion 335 and mounted in the mounting portion 336, the end portion on the first direction side of the elastic member 45 is positioned on the side of the first outer surface 345, via the mounting open portion 339. The two protrusions 337 are inserted through the inside of the two round hole portions 451. As shown in FIG. 4 and FIG. 8, the elastic member 45 extends in the second direction. The shaft portion 43 takes up the end portion on the second direction side of the elastic member 45. A restoring force in the first direction is generated by the elastic member 45. Thus, the elastic member 45 urges the shaft member 43 in the first direction.

Figure 11:
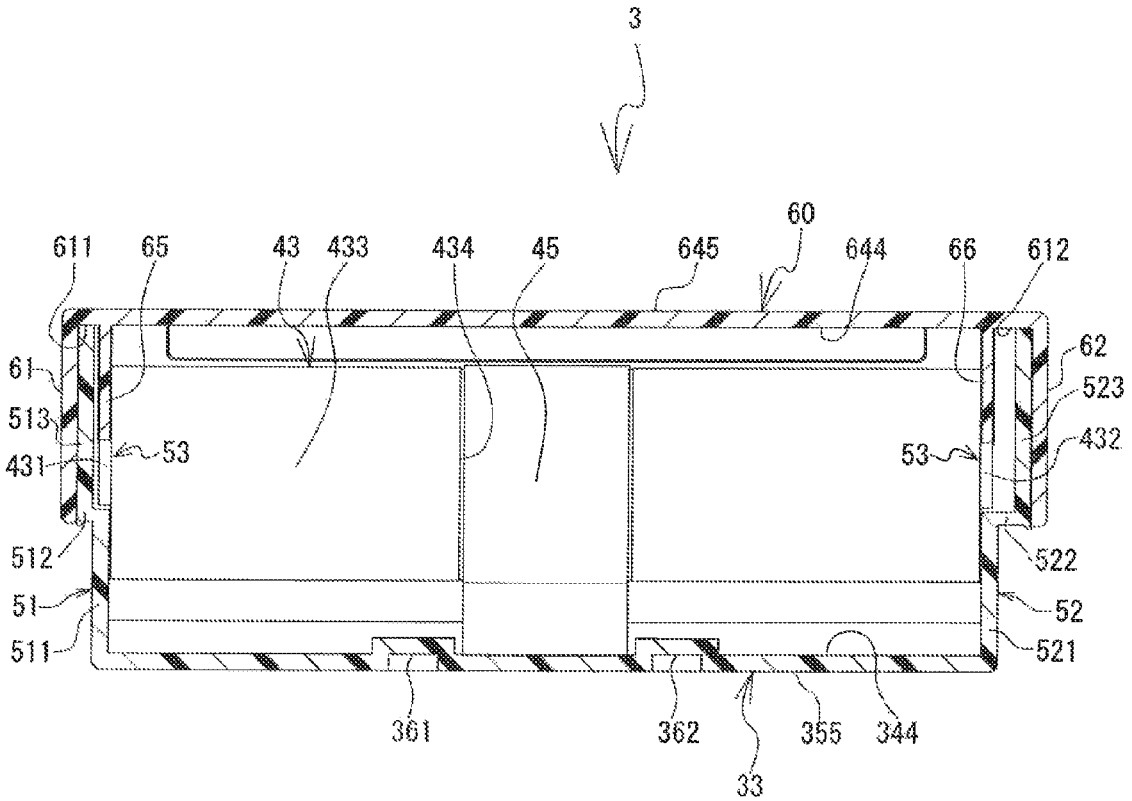
FIG. 11 is a cross-sectional view along a line A-A shown in FIG. 3.
Figure 11:
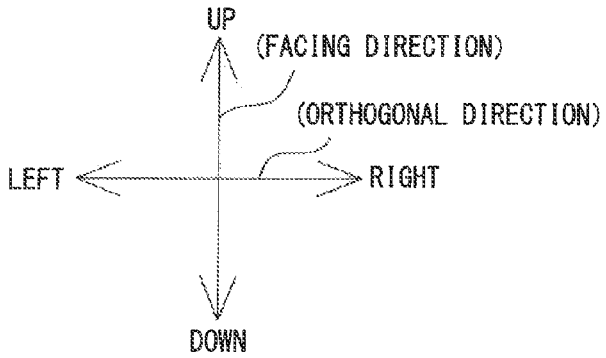

The pair of side walls 51 and 52 will be explained in detail. An illustration of the liquid storage bag 13 is omitted from FIG. 11. As shown in FIG. 8 and FIG. 11, the left side wall 51 is provided with a first portion 511, a second portion 512 and a third portion 513. The right side wall 52 is provided with a first portion 521, a second portion 522 and a third portion 523. The first portions 511 and 521 are wall portions that extend upward from each of the lower end portions of the side walls 51 and 52. The first portions 511 and 521 protrude upward from each of end portions of the first inner surface 344 in the orthogonal direction. The first portions 511 and 521 are provided from each of end portions in the second direction of the first case 33 and extended along the first direction. The protruding end portions 431 and 432 are clamped and supported by upper ends of the first portions 511 and 512 and lower ends of the protruding wall portions 65 and 66 of the second case 60 (refer to FIG. 11).

The second portions 512 and 522 protrude outward of the case 3 in the orthogonal direction from the upper ends of the first portions 511 and 521. The third portions 513 and 523 extend upward from the end portions of the second portions 512 and 522.

The shaft portion 43 will be explained. As shown in FIG. 8 and FIG. 11, the shaft portion 43 is a circular column and extends in the orthogonal direction. An outer peripheral surface 433 of the shaft portion 43 is smooth in the peripheral direction. The shaft portion 43 is provided with the protruding end portions 431 and 432, and a shaft recessed portion 434. The protruding end portions 431 and 432 protrude, respectively, in the orthogonal direction from the pair of end portions of the shaft portion 43 in the orthogonal direction. The shaft recessed portion 434 is a recessed portion that is recessed toward the center axis of the shaft portion 43, in the outer peripheral surface 433 of the shaft portion 43. The shaft recessed portion 434 is provided in a center portion, in the orthogonal direction, of the shaft portion 43. The shaft recessed portion 434 takes up the end portion on the second direction side of the elastic member 45.

As shown in FIG. 11, the protruding end portions 431 and 432 are positioned between the first portions 511 and 521 of the first case 33 and the protruding wall portions 65 and 66 (to be explained later) of the second case 60. When the shaft portion 43 moves as a result of the urging force of the elastic member 45, the protruding end portions 431 and 432 move along movement paths 53 (refer to FIG. 11, FIG. 19 and FIG. 23A), which extend in the front-rear direction and which are formed by the first portions 511 and 521 and the protruding wall portions 65 and 66. Note that, in FIG. 19 to FIG. 22, in order to make a state of a first side plate portion 47 and a second side plate portion 48 (which will be described later) more easy to understand, an illustration of a portion of the protruding wall 66 that overlaps with the first side plate portion 47 and the second side plate portion 48 is omitted.

The shaft portion 43 advances in the first direction while taking up the liquid storage bag 13 and thus gathering the ink toward the plug 7. In other words, the further the shaft portion 43 is positioned in the first direction, the smaller a remaining amount of ink inside the liquid storage portion 133. Thus, if the position of the shaft portion 43 in the first direction is displayed, it is possible to display the remaining amount of ink inside the liquid storage portion 133. The case 32 has the detection portion 46 (refer to FIG. 14) that is used to display the remaining amount of ink. The detection portion 46 and a structure that supports the detection portion 46 will be explained in detail later.

The second case 60 will be explained. As shown in FIG. 8 and FIG. 11 to FIG. 13, the second case 60 is provided with an upper wall portion 64, a pair of side walls 61 and 62, the protruding wall portions 65 and 66 (refer to FIG. 11), groove portions 611 and 612 (refer to FIG. 11) and pressing wall portions 67 and 68 (refer to FIG. 12). The upper wall portion 64 extends in the first direction from the rear end portion of the second case 60. The upper wall portion 64 is provided with a second inner surface 644, which is the bottom surface of the upper wall portion 64, and a second outer surface 645, which is on the opposite side of the second inner surface 644. As shown in FIG. 8, the first inner surface 344 of the first case 33 and the second inner surface 644 of the second case 60 face each other in the facing direction. The end portion on the second direction side of the second outer surface 645 has an outer surface recessed portion 641, which is recessed downward. The outer surface recessed portion 641 has a rectangular shape that is long in the orthogonal direction in a plan view. When the operator slides the second case 60 with respect to the first case 33, the operator moves the second case 60 by placing his/her finger in the outer surface recessed portion 641, for example.

Figure 12:
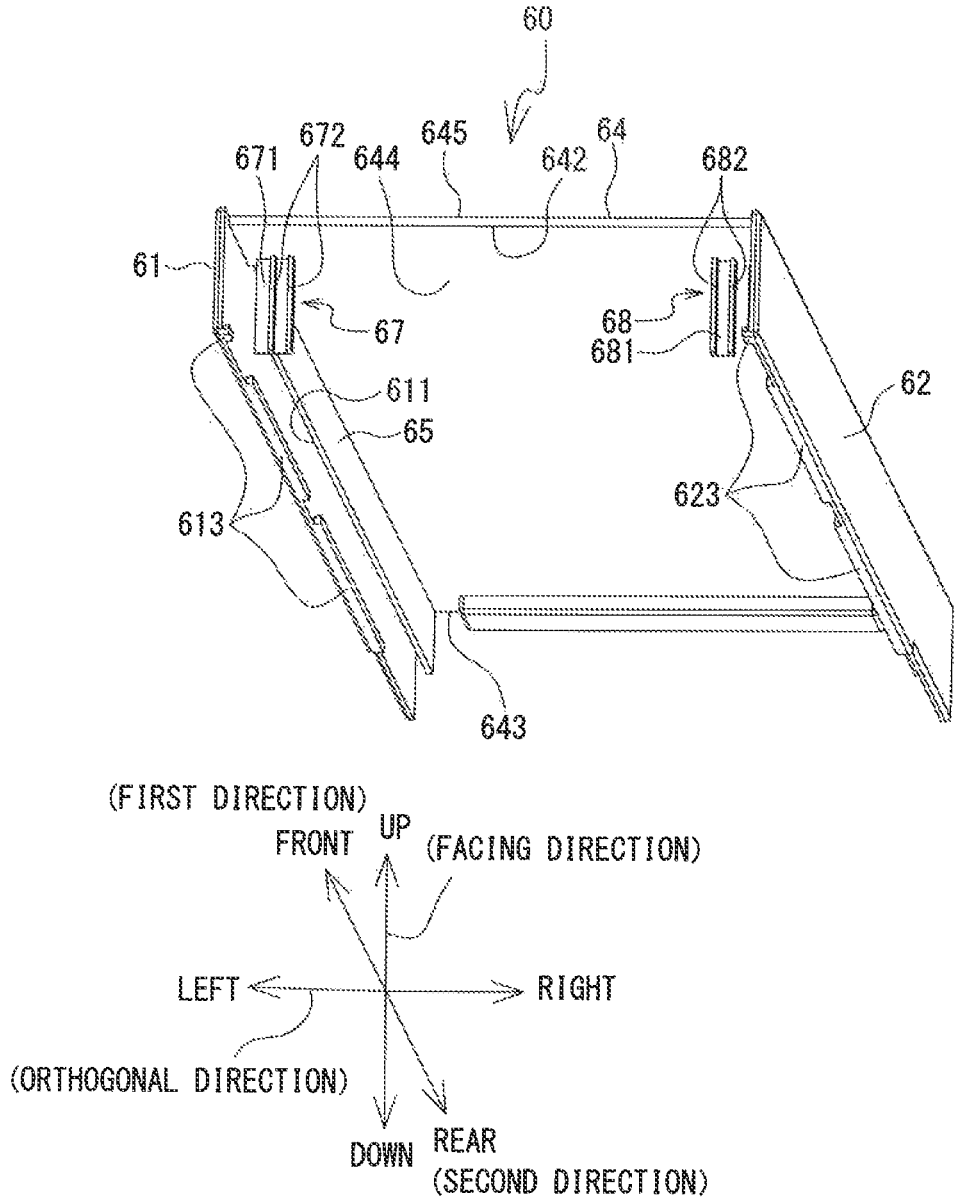
FIG. 12 is a perspective view of a second case.
Figure 13:
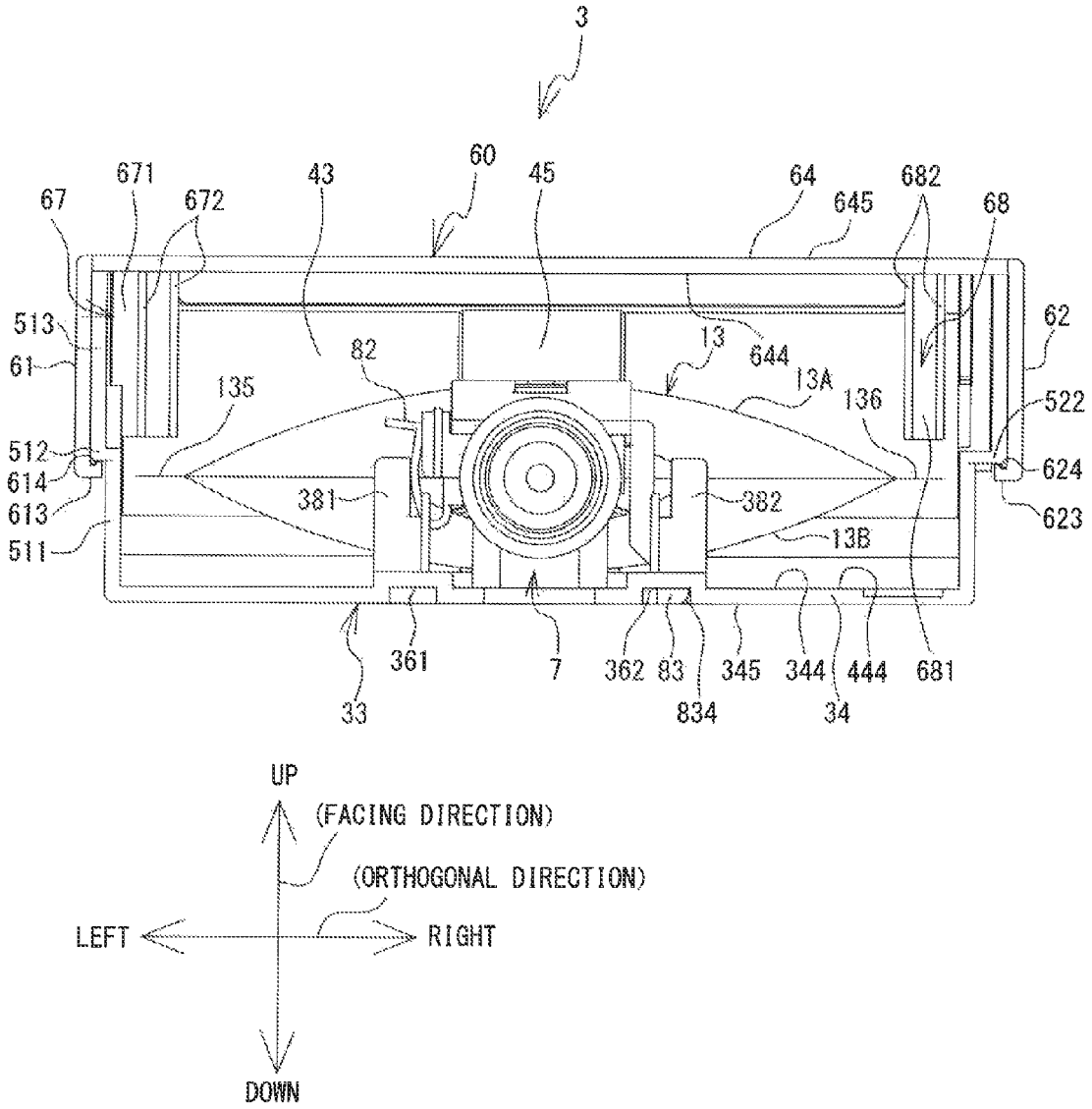
FIG. 13 is a front view of the cartridge.

The pair of side walls 61 and 62 respectively extend downward from the end portions in the orthogonal direction of the second inner surface 644. As shown in FIG. 12 and FIG. 13, each of the lower end portions of the pair of side walls 61 and 62 are provided with a plurality of leading end wall portions 613 and 623. The leading end wall portions 613 and 623 respectively protrude from the side walls 61 and 62 toward the inside in the orthogonal direction.

As shown in FIG. 13, when the second case 60 is mounted on the first case 33, the pair of side walls 61 and 62 of the second case 60 are positioned on the outside of the pair of side walls 51 and 52 of the first case 33. Namely, the first case 33 is an inner case and the second case 60 is an outer case. The second portions 512 and 522 of the side walls 51 and 52 face upper surfaces 614 and 624, which are surfaces of the leading end wall portions 613 and 623 on the side of the second inner surface 644. As a result, the second portions 512 and 522 and the leading end wall portions 613 and 623 engage with each other.

As shown in FIG. 12, the end portion on the first direction side of the second case 60 is provided with an open portion 642, which opens in the front-rear direction. The end portion on the second direction side of the second case 60 is provided with an open portion 643, which opens in the front-rear direction.

As shown in FIG. 11, the protruding wall portions 65 and 66 are wall portions that are provided facing the side walls 61 and 62, respectively, on the inside of the side walls 61 and 62 in the orthogonal direction. The protruding wall portions 65 and 66 extend from the second inner surface 644 toward the first inner surface 344 (refer to FIG. 12) between the end portion on the second direction side of the second case 60 and a position which is near to the end portion on the first direction side of the second case 60. The groove portion 611 is a groove that is recessed upward and that is formed between the protruding wall portion 65 and the side wall 61. The groove portion 612 is a groove that is recessed upward and that is formed between the protruding wall portion 66 and the side wall 62. The third portions 513 and 523 of the pair of side walls 51 and 52 of the first case 33 are positioned inside the groove portions 611 and 612, respectively.

As shown in FIG. 12, the pressing wall portions 67 and 68 protrude downward, (namely, to the side of the first inner surface 344), from the end portions in the first direction of the second inner surface 644. The pressing wall portions 67 and 68 are positioned further to the first direction side than the shaft portion 43 when the shaft portion 43 is positioned in a second position that will be explained later (refer to FIG. 23A). As shown in FIG. 13, the pressing wall portions 67 and 68 are provided on the end portions in the orthogonal direction of the second case 60. The elastic member 45 are positioned between the pressing wall portions 67 and 68. As shown in FIG. 12 and FIG. 13, the pressing wall portion 67 is provided with a first wall portion 671 and two second wall portions 672. The pressing wall portion 68 is provided with a first wall portion 681 and two second wall portions 682. Each of the first wall portions 671 and 681 is a wall portion that faces the shaft portion 43 and that has a flat surface that is parallel to the orthogonal direction. The two second wall portions 672 protrude in the first direction from the center portion and the right end portion in the orthogonal direction of the first wall portion 671. The two second wall portions 682 protrude in the first direction from the end portions in the orthogonal direction of the first wall portion 681.

Figure 14:
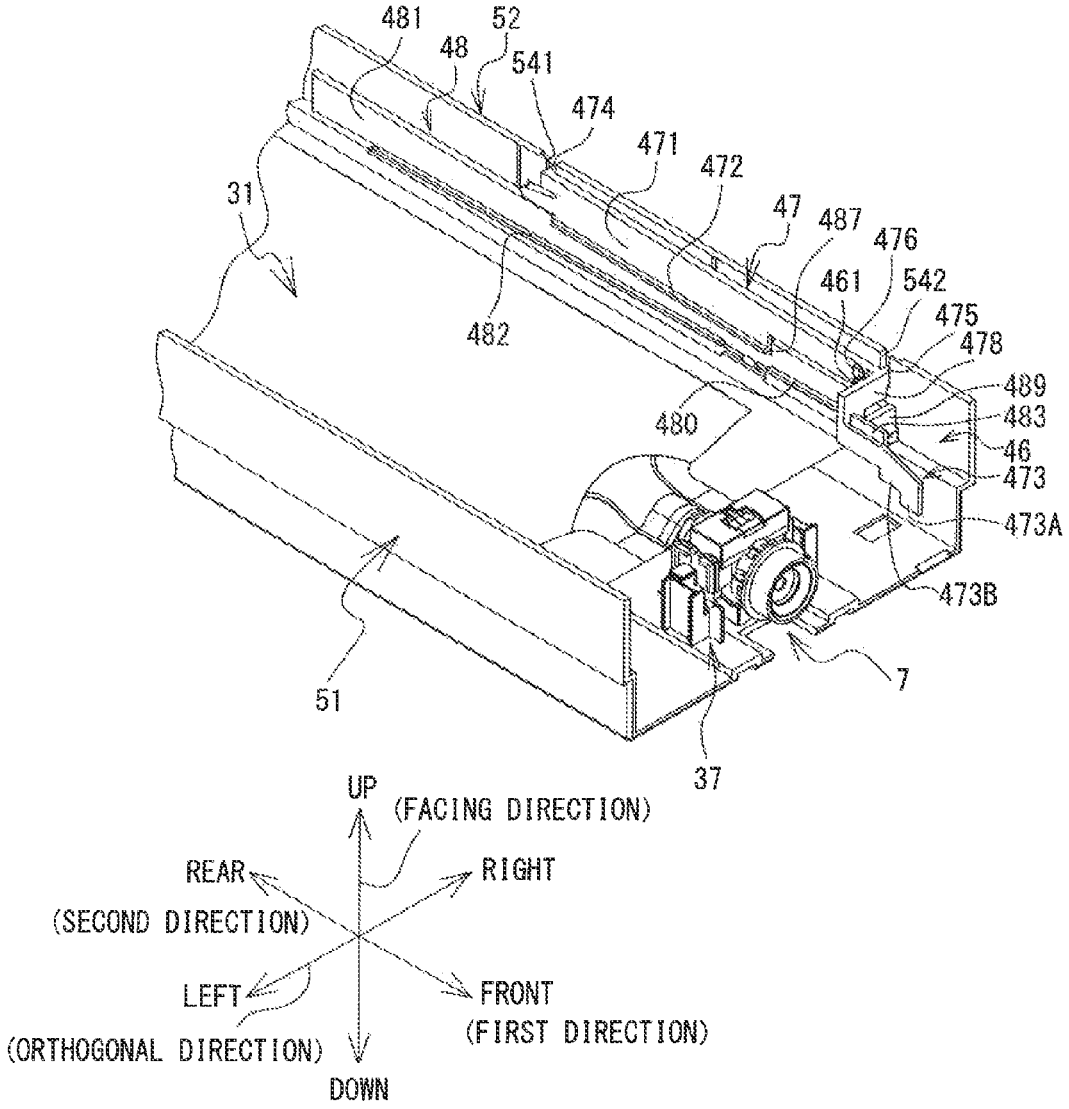
FIG. 14 is a perspective view of the front end portion of the first case.

The detection portion 46 will be explained in detail. As shown in FIG. 8 and FIG. 14, the detection portion 46 is provided with the first side plate portion 47, the second side plate portion 48 and a coil spring 461. The first side plate portion 47 and the second side plate portion 48 are arranged on the right end portion of the end portions in the orthogonal direction, on the end portion in the first direction of the case 32, and extend in the first direction. The first side plate portion 47 is arranged on the upper side of the second side plate portion 48.

Figure 15:
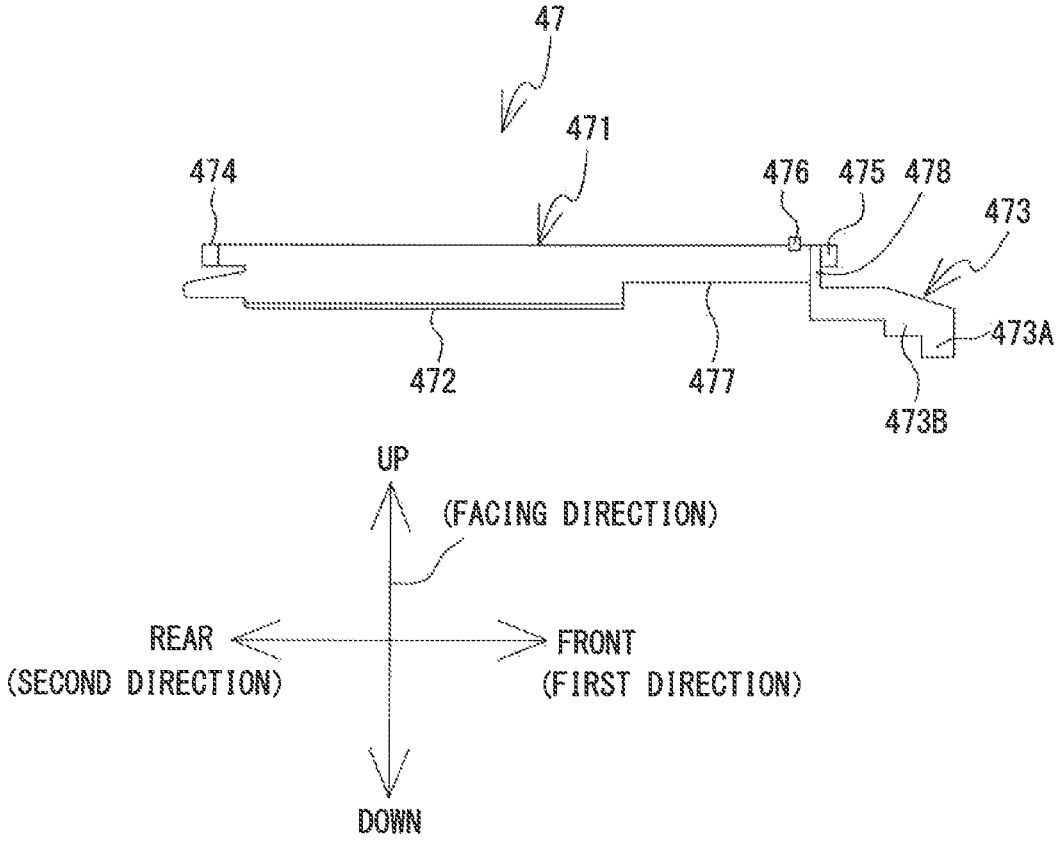
FIG. 15 is a left side view of a first side plate portion.
Figure 16:
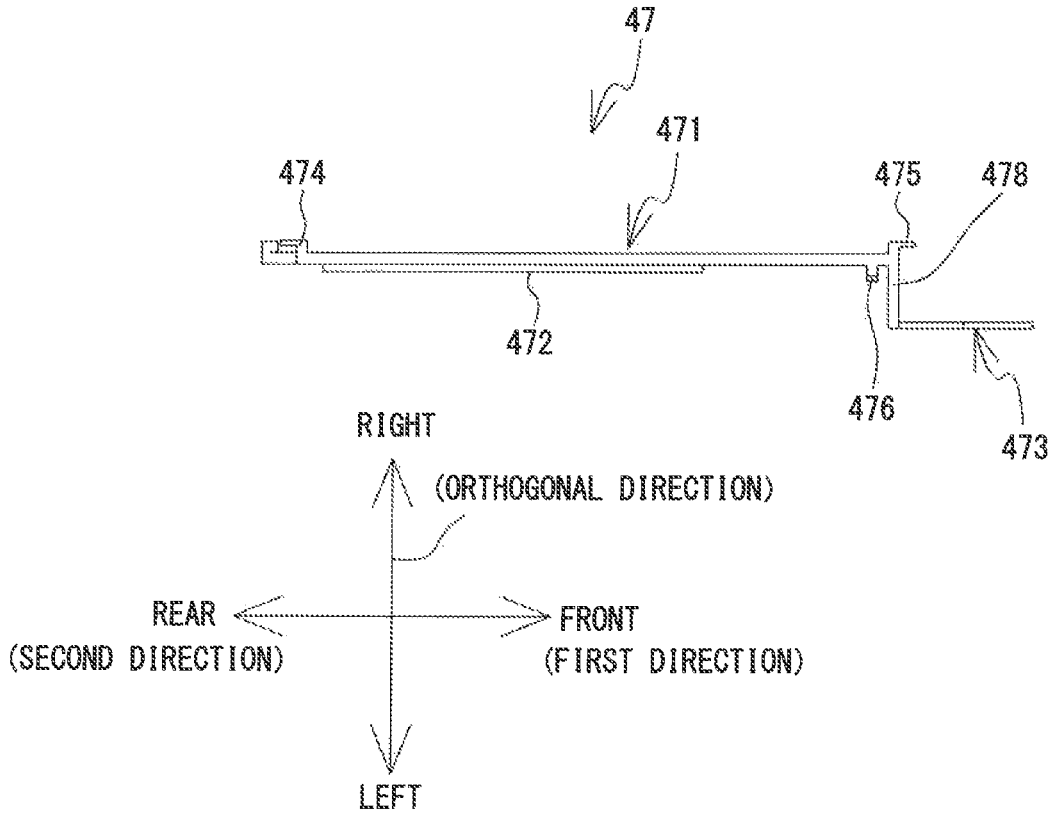
FIG. 16 is a plan view of the first side plate portion.

As shown in FIG. 15 and FIG. 16, the first side plate portion 47 is provided with a first arm portion 471, a first contact portion 472, a first display portion 473, first side plate engagement portions 474 and 475 and a first spring mounting portion 476. The first display portion 473 is provided on the end portion in the first direction of the first side plate portion 47. The first arm portion 471 is a plate shaped portion that extends in the first direction, and is positioned further to the second direction side than the first display portion 473. A cutout portion 477, which is cutout in the upward direction, is formed in the lower end of the end portion in the first direction of the first arm portion 471.

The first contact portion 472 protrudes from a portion in the facing direction of the first arm portion 471 to the left, which is the inside in the orthogonal direction. More specifically, the first contact portion 472 protrudes to the left, which is the inside in the orthogonal direction, from a lower end of a portion, which is further to the second direction side than the cutout portion 477, of the first arm portion 471. In the front-rear direction, the first contact portion 472 extends in the first direction from a position that is slightly to the first direction side of the rear end portion of the first arm portion 471. The end portion on the first direction side of the first contact portion 472 is slightly further to the first direction side than a center portion in the front-rear direction of a second arm portion 481.

A wall portion 478, which extends to the left (i.e., inside in the orthogonal direction), is connected to the end portion in the first direction of the first arm portion 471. The first display portion 473 is a plate shaped portion that extends in the first direction from the lower end portion on the left end of the wall portion 478. Specifically, the first display portion 473 is positioned further to the left side, namely further to the inside in the orthogonal direction, than the first arm portion 471. The first display portion 473 includes a first display protruding portion 473A and a second display protruding portion 473B. The first display protruding portion 473A is a portion that protrudes downward from the leading end in the first direction of the first display portion 473. The second display protruding portion 473B is a portion that protrudes downward from the rear side of the first display protruding portion 473A. The lower end of the second display protruding portion 473B is positioned higher than the lower end of the first display protruding portion 473A.

The first side plate engagement portions 474 and 475 are portions that respectively engage with first support open portions 541 and 542 (refer to FIG. 9, to be explained later) of the first case 33. The first side plate engagement portions 474 and 475 are provided such that they are separated from each other in the first direction. The first side plate engagement portion 474 is provided on an upper portion of the end portion in the second direction of the first arm portion 471. The first side plate engagement portion 474 protrudes to the right from the first arm portion 471 and its right end extends in the second direction. The first side plate engagement portion 475 is provided on an upper portion of the end portion in the first direction of the first arm portion 471. The first side plate engagement portion 475 protrudes to the right from the first arm portion 471 and its right end extends in the first direction.

The first spring mounting portion 476 is provided on the second direction side of the first side plate engagement portion 475. The first spring mounting portion 476 protrudes to the left from the upper end of the first arm portion 471 and the left end portion of the first spring mounting portion 476 extends upward. An upper mounting portion 462 (refer to FIG. 8) of the coil spring 461 is mounted on the first spring mounting portion 476.

Figure 17:
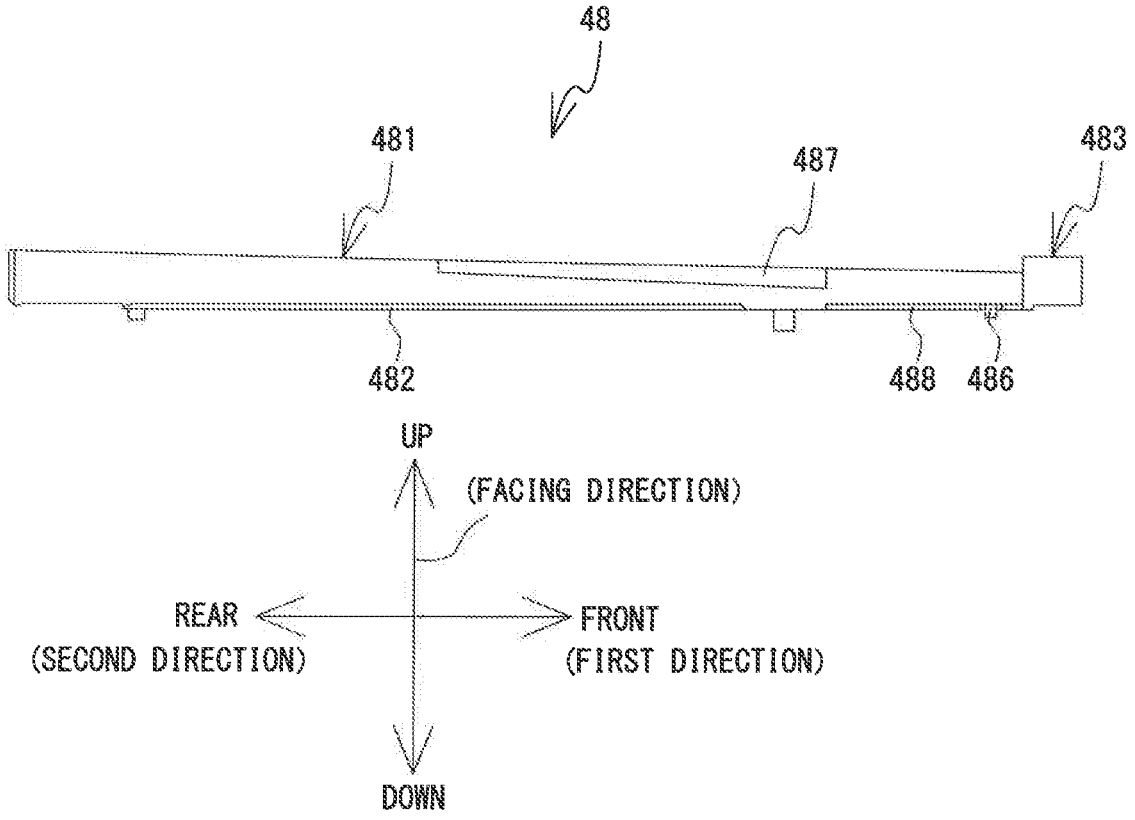
FIG. 17 is a left side view of a second side plate portion.
Figure 18:
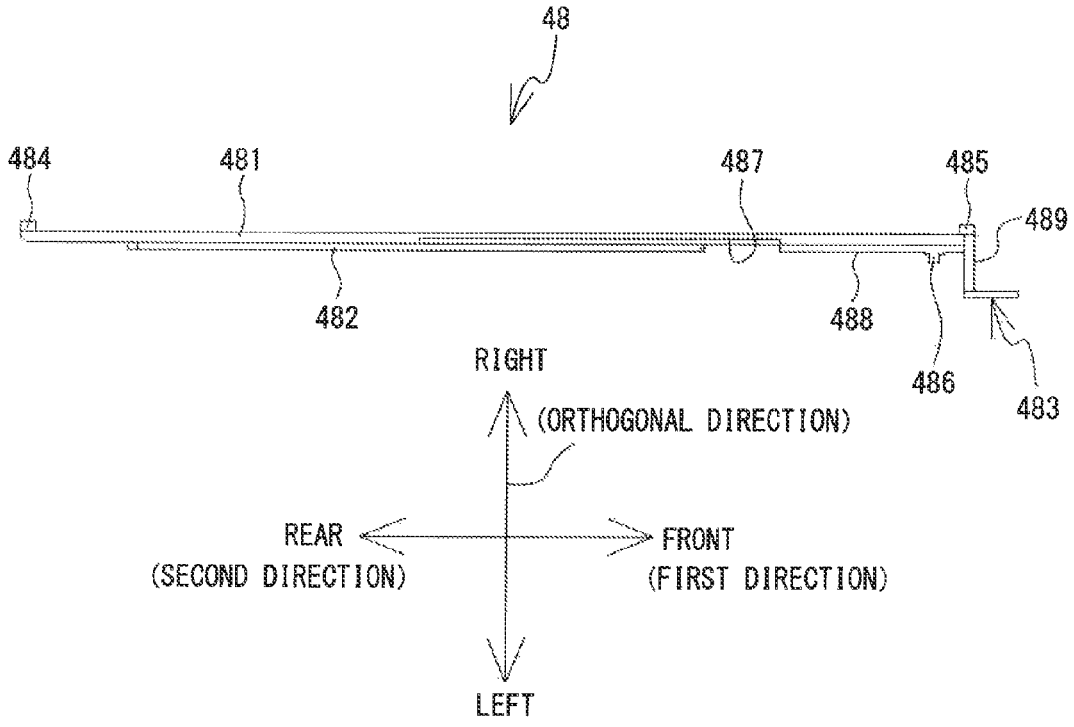
FIG. 18 is a plan view of the second side plate portion.

As shown in FIG. 17 and FIG. 18, the second side plate portion 48 is provided with the second arm portion 481, a second contact portion 482, the second display portion 483, second side plate engagement portions 484 and 485, a second spring mounting portion 486, an arm recessed portion 487 and a protruding portion 488. The second display portion 483 is provided on the end portion in the first direction of the second side plate portion 48. The second arm portion 481 is a plate shaped portion that extends in the first direction, and is positioned further to the second direction side than the second display portion 483. A length in the front-rear direction of the second arm portion 481 of the second side plate portion 48 is longer than a length in the front-rear direction of the first arm portion 471 of the first side plate portion 47.

The second contact portion 482 protrudes from a portion in the facing direction of the second arm portion 481 to the left, which is the inside in the orthogonal direction. More specifically, the second contact portion 482 protrudes to the left, which is the inside in the orthogonal direction, from the lower end of the second arm portion 481. In the front-rear direction, the second contact portion 482 extends in the first direction from a position that is slightly to the first direction side of the rear end portion of the second arm portion 481. The end portion on the first direction side of the second contact portion 482 is slightly further to the first direction side than a center portion in the front-rear direction of the second arm portion 481. The protruding portion 488 is provided on the first direction side of the second contact portion 482, on the lower end of the second arm portion 481. The second contact portion 482 and the protruding portion 488 are provided such that they are separated from each other in the first direction.

The arm recessed portion 487 is provided on the upper end portion of the second arm portion 481 and is recessed to the right. The end portion on the second direction side of the arm recessed portion 487 is positioned above the center portion in the front-rear direction of the second contact portion 482, and the end portion on the first direction side of the arm recessed portion 487 is positioned above the end portion on the second direction side of the protruding portion 488. When the first side plate portion 47 and the second side plate portion 48 are mounted in the first case 33, the first contact portion 472 is arranged to the left side of the arm recessed portion 487 (refer to FIG. 14).

A wall portion 489 (refer to FIG. 18), which extends to the left (i.e., inside in the orthogonal direction), is connected to the end portion in the first direction of the second arm portion 481. The second display portion 483 is a plate shaped portion that extends in the first direction from the left end of the wall portion 489. Specifically, the second display portion 483 is positioned further to the left side, namely further to the inside in the orthogonal direction, than the second arm portion 481. The second display portion 483 is a rectangular shape in a left side view.

The second side plate engagement portions 484 and 485 are portions that respectively engage with second support open portions 551 and 552 (refer to FIG. 9, to be explained later) of the first case 33. The second side plate engagement portions 484 and 485 are provided such that they are separated from each other in the first direction. The second side plate engagement portion 484 is provided on the lower end of the end portion in the second direction of the second arm portion 481, and protrudes to the right from the second arm portion 481. The second side plate engagement portion 485 is provided on the lower end of the end portion in the first direction of the second arm portion 481, and protrudes to the right from the second arm portion 481.

The second spring mounting portion 486 is provided on the second direction side of the second side plate engagement portion 485. The second spring mounting portion 486 protrudes to the left from the lower end of the second arm portion 481 and the left end portion of the second spring mounting portion 486 extends downward. A lower mounting portion 463 (refer to FIG. 8) of the coil spring 461 is mounted on the second spring mounting portion 486. As shown in FIG. 8, the coil spring 461 extends in the facing direction. The upper end portion of the coil spring 461 is provided with the upper mounting portion 462, which is ring shaped and which can be mounted on the first spring mounting portion 476. The lower end portion of the coil spring 461 is provided with the lower mounting portion 463, which is ring shaped and which can be mounted on the second spring mounting portion 486.

A structure of the first case 33 that supports the first side plate portion 47 and the second side plate portion 48 will be explained. As shown in FIG. 9, concave and convex portions that correspond to the first side plate portion 47 and the second side plate portion 48 are formed in the end portion in the first direction of the side wall 52. The first support open portions 541 and 542, and the second support open portions 551 and 552 are provided in the end portion on the first direction side of the side wall 52 of the first case 33. The first support open portions 541 and 542 are arranged such that they are separated from each other in the first direction. The first support open portions 541 and 542 are open portions that extend in the facing direction, and are formed by cutting out the upper end of the side wall 52 in the downward direction. A distance between the first support open portions 541 and 542 corresponds to a distance between the first side plate engagement portions 474 and 475 of the first side plate portion 47 (refer to FIG. 16). The first support open portions 541 and 542 support the first side plate portion 47 such that the first display portion 473 (refer to FIG. 16) can move in the facing direction.

The second support open portions 551 and 552 are arranged such that they are separated from each other in the first direction. The second support open portions 551 and 552 are open portions that extend in the facing direction and are formed in the lower end portion of the third portion 523 of the side wall 52. A distance between the second support open portions 551 and 552 corresponds to a distance between the second side plate engagement portions 484 and 485 (refer to FIG. 18) of the second side plate portion 48. The second support open portions 551 and 552 support the second side plate portion 48 such that the second display portion 483 (refer to FIG. 18) can move in the facing direction.

As shown in FIG. 8 and FIG. 14, the first side plate portion 47 is supported by the side wall 52 through the first side plate engagement portions 474 and 475 engaging with the first support open portions 541 and 542. The second side plate portion 48 is supported by the side wall 52 through the second side plate engagement portions 484 and 485 engaging with the second support open portions 551 and 552. In a state of being stretched in the facing direction, the coil spring 461 is stretched between the first spring mounting portion 476 and the second spring mounting portion 486. Due to the restoring force of the coil spring 461, the first spring mounting portion 476 is urged downward while the second spring mounting portion 486 is urged upward.

Figure 19:
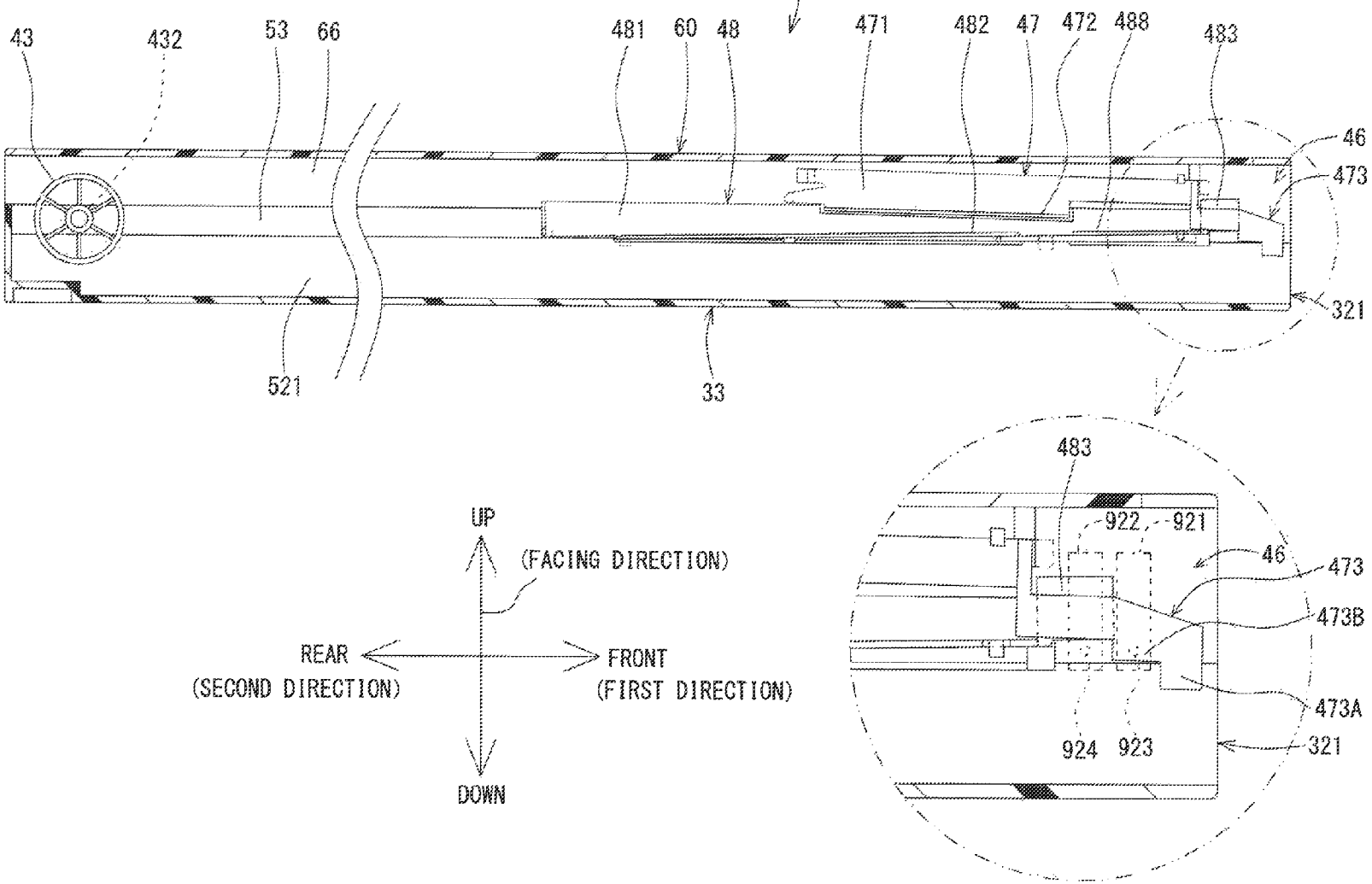
FIG. 19 is a cross-sectional view along a line B-B shown in FIG. 3, when a first display portion and a second display portion are in a first state.

As shown in FIG. 19, with respect to the movement path 53 of the protruding end portion 432 of the shaft portion 43, the first contact portion 472 is arranged in an inclined manner such that the further it extends in the first direction, the further downward it is positioned. With respect to the movement path 53 of the protruding end portion 432, the second contact portion 482 is arranged in an inclined manner such that the further it extends in the first direction, the further upward it is positioned. The first contact portion 472 and the second contact portion 482 come into contact with the protruding end portion 432 that moves in the first direction.

As will be described in more detail later, the case 32 can display the remaining amount of ink by causing the first display portion 473 and the second display portion 483 to move their positions in the facing direction, in accordance with the remaining amount of ink. The first display portion 473 moves between a lower position (refer to FIG. 19 and FIG. 20) and an upper position (refer to FIG. 21 and FIG. 22). The second display portion 483 moves between a lower position (refer to FIG. 20 and FIG. 21) and an upper position (refer to FIG. 19 and FIG. 22). Combinations of the positions of the first display portion 473 and the second display portion 483 change from a first state to a fourth state, as shown in FIG. 19 to FIG. 22. As shown in FIG. 19 to FIG. 22, two optical detection portions 921 and 922 are provided in the printer 1. The optical detection portions 921 and 922 respectively have light emitting portions 923 and 924 and light receiving portions (not shown in the drawings). When the cartridge 3 is mounted in the cartridge mounting portion 8, in the orthogonal direction, the light emitting portion 923 of the optical detection portion 921 is positioned to the left of the second display protruding portion 473B of the first display portion 473, and the light receiving portion is arranged to the right of the second display protruding portion 473B. Further, in the orthogonal direction, the light emitting portion 924 of the optical detection portion 922 is arranged to the left of the second display portion 483 and the light receiving portion is arranged to the right of the second display portion 483.

It is assumed that when light emitted by the light emitting portions 923 and 924 is detected by the light receiving portions, the optical detection portions 921 and 922 output "1". It is assumed that when the light emitted by the light emitting portions 923 and 924 is blocked by the first display portion 473 or the second display portion 483 and is not detected by the light receiving portions, the optical detection portions 921 and 922 output "0". By detecting a combination of "1" and "0" that are output values of the optical detection portions 921 and 922, a CPU (not shown in the drawings) of the printer 1 detects the remaining amount of ink. Detection modes for detecting the remaining amount of ink will be explained in detail later.

Figure 21:
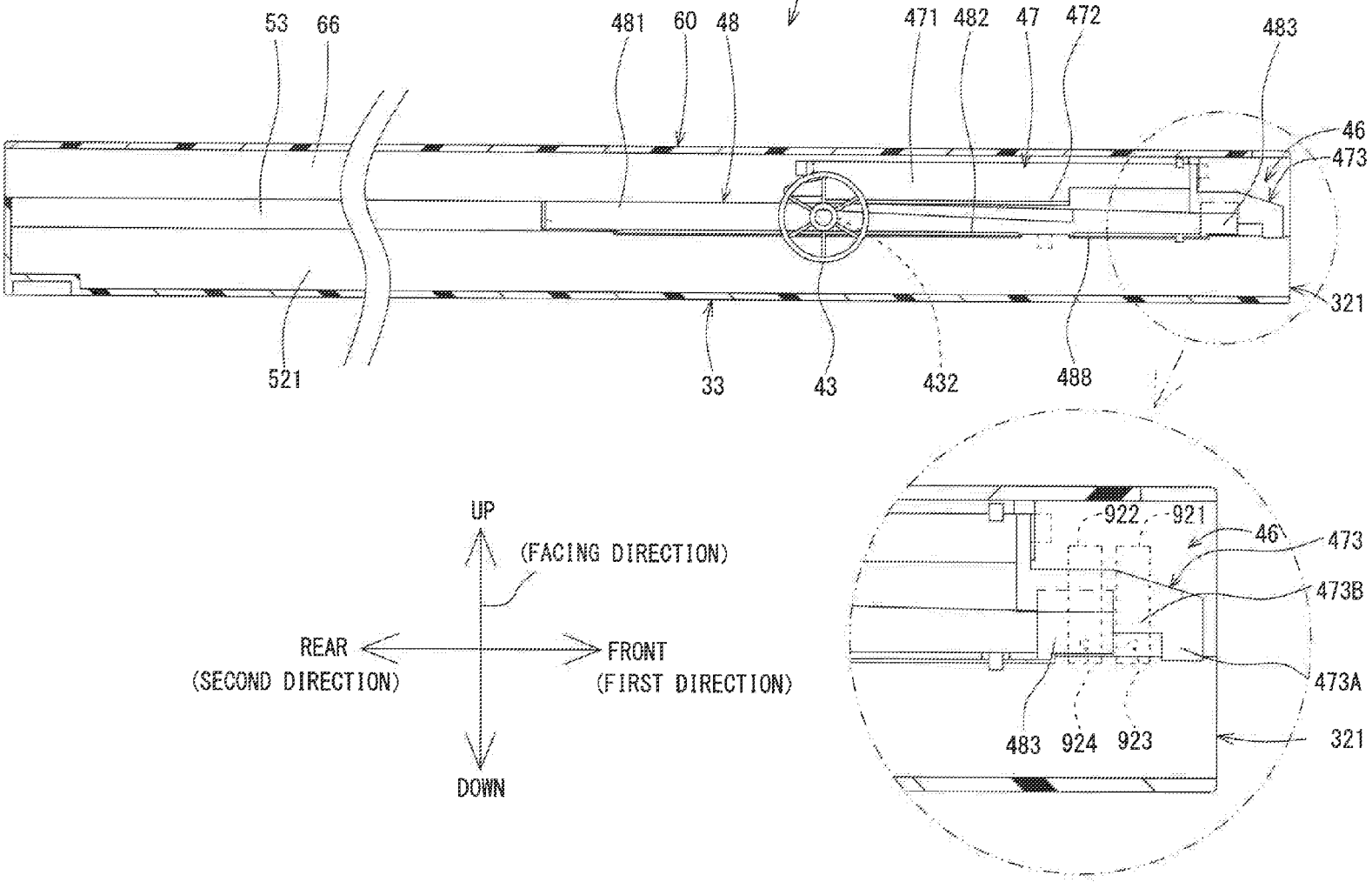
FIG. 21 is a cross-sectional view along the line B-B shown in FIG. 3, when the first display portion and the second display portion are in a third state.
Figure 22:
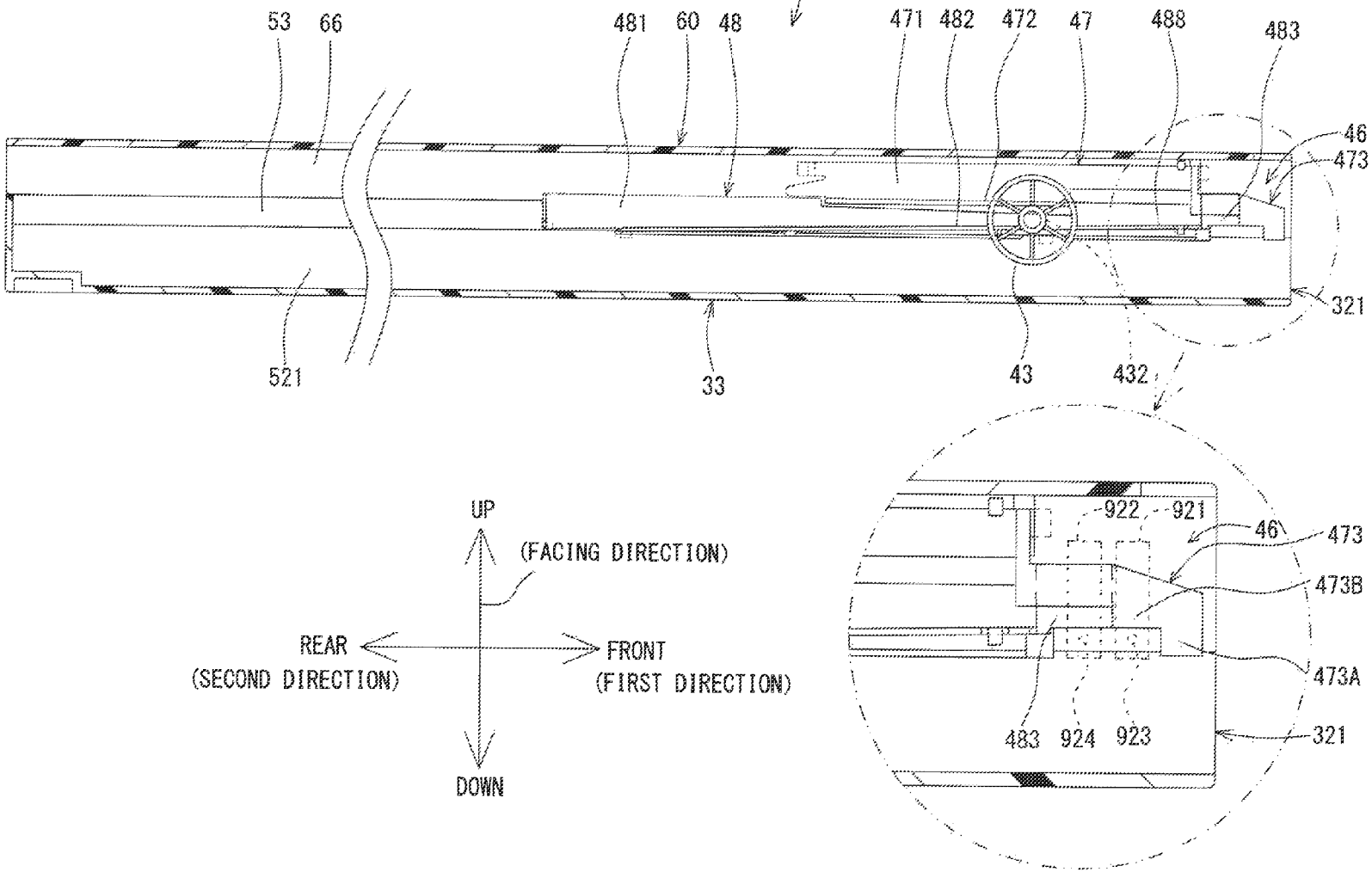
FIG. 22 is a cross-sectional view along the line B-B shown in FIG. 3, when the first display portion and the second display portion are in a fourth state.
Figure 23A:
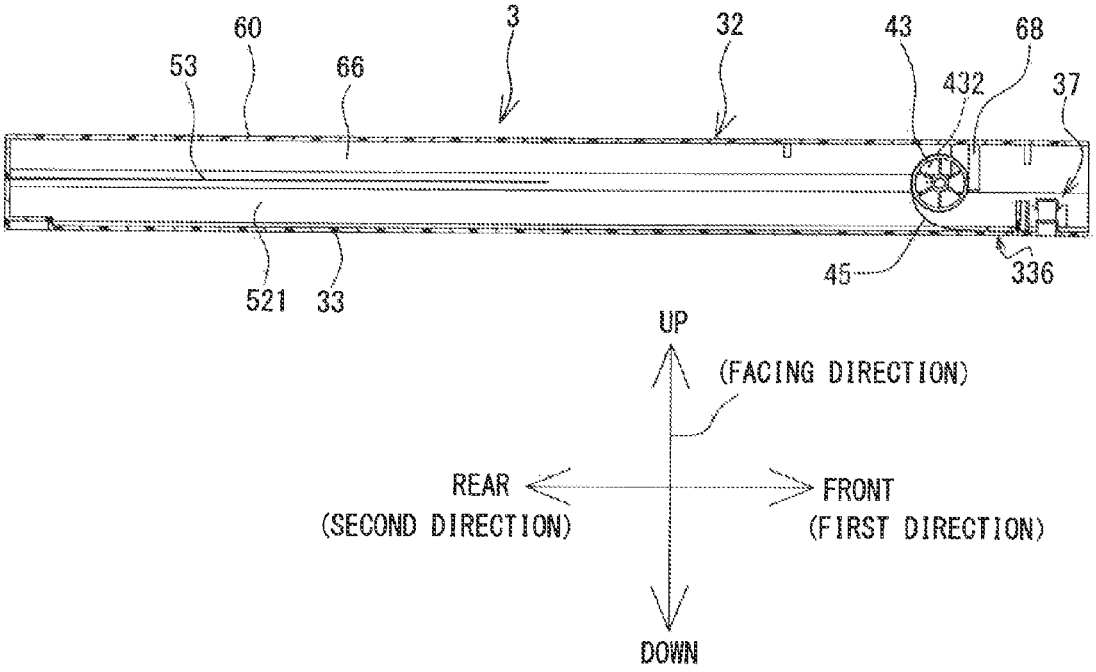
FIG. 23A is a cross-sectional view along a line B-B shown in FIG. 3.
Figure 23B:
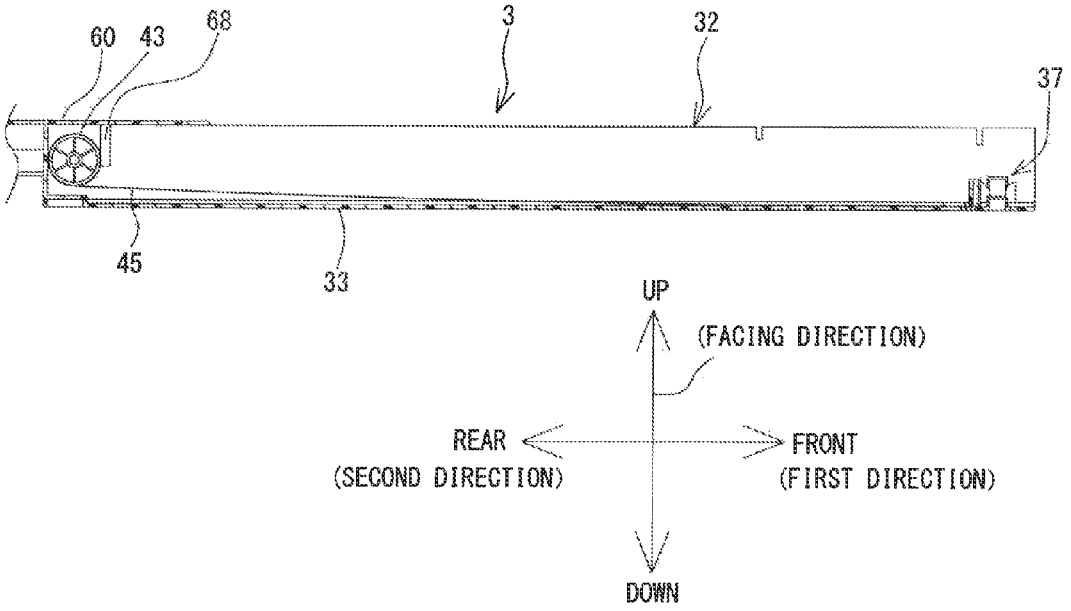
FIG. 23B is a cross-sectional view and is a continuation of FIG. 23A.

An operation will be explained in which the operator assembles the case 32, mounts the liquid storage body 31 in the case 32 and mounts the case 32 in the cartridge mounting portion 8. For example, when the cartridge 3 is manufactured in a manufacturing factory of the cartridge 3, or when the cartridge 3 is used in a factory or a household that uses the printer 1, the operator performs the operation to assemble the case 32 and mount the liquid storage body 31 in the case 32. For example, in the factory or such place that uses the printer 1, at a time of replacing the liquid storage body 31 inside the cartridge 3, the operator first removes the used liquid storage body 31 from the case 32 and then mounts the new liquid storage body 31 in the case 32. In the following explanation, of a movable range of the shaft portion 43, a position furthest to the second direction side as shown in FIG. 23B is referred to as a first position. Of the movable range on the first direction side from the first position, a position that is furthest to the first direction side as shown in FIG. 23A is referred to as the second position. In FIG. 19 to FIG. 22, an illustration of the liquid storage body 31 is omitted. FIG. 23A to FIG. 23D, and FIG. 24A to FIG. 24D are simplified diagrams, and an illustration of the detection portion 46 etc. is omitted. In FIG. 23A to FIG. 23D and FIG. 24A to FIG. 24D, of the pressing wall portions 67 and 68, only the pressing wall portion 68 is shown. In FIG. 23A to FIG. 23D and FIG. 24A to FIG. 24D, the movement paths 53 are only shown in FIG. 23A.

As shown in FIG. 8, at the time of assembly of the case 32, the operator arranges the elastic member 45 in the case recessed portion 335 of the first case 33. The operator arranges the end portion on the first direction side of the elastic member 45 on the mounting portion 336, and takes up the end portion on the second direction side of the elastic member 45 onto the shaft recessed portion 434 of the shaft portion 43. The operator places the protruding end portions 431 and 432 of the shaft portion 43 on the upper side of the first portions 511 and 521, and arranges the shaft portion 43 in the first case 33. The operator arranges the second case 60 on top of the first case 33 while sliding the second case 60 in the second direction from the first direction side of the first case 33. At this time, the protruding end portions 431 and 432 of the shaft portion 43 are positioned between the first portions 511 and 521 of the first case 33 and the protruding wall portions 65 and 66 (refer to FIG. 11). The second case 60 slides in the second direction with respect to the first case 33. The operator arranges the detection portion 46 in the first case 33. The operator assembles the case 32 in the above-described manner. An order of assembly of each structural member is optional and is not limited to the above-described order.

As shown in FIG. 23A, when the liquid storage body 31 is not mounted in the case 32, the shaft portion 43 moves to the second position as a result of the urging force of the elastic member 45. The pressing wall portions 67 and 68 of the second case 60 are positioned on the first direction side of the shaft portion 43. As shown in FIG. 23B, the operator slides the second case 60 in the second direction with respect to the first case 33, and opens the second case 60, which forms a lid of the case 32. With the sliding of the second case 60, the pressing wall portions 67 and 68 push the shaft portion 43 in the second direction and the shaft portion 43 moves to the first position along the movement paths 53. The elastic member 45 is extended according to the movement of the shaft portion 43 toward the first position.

Figure 23C:
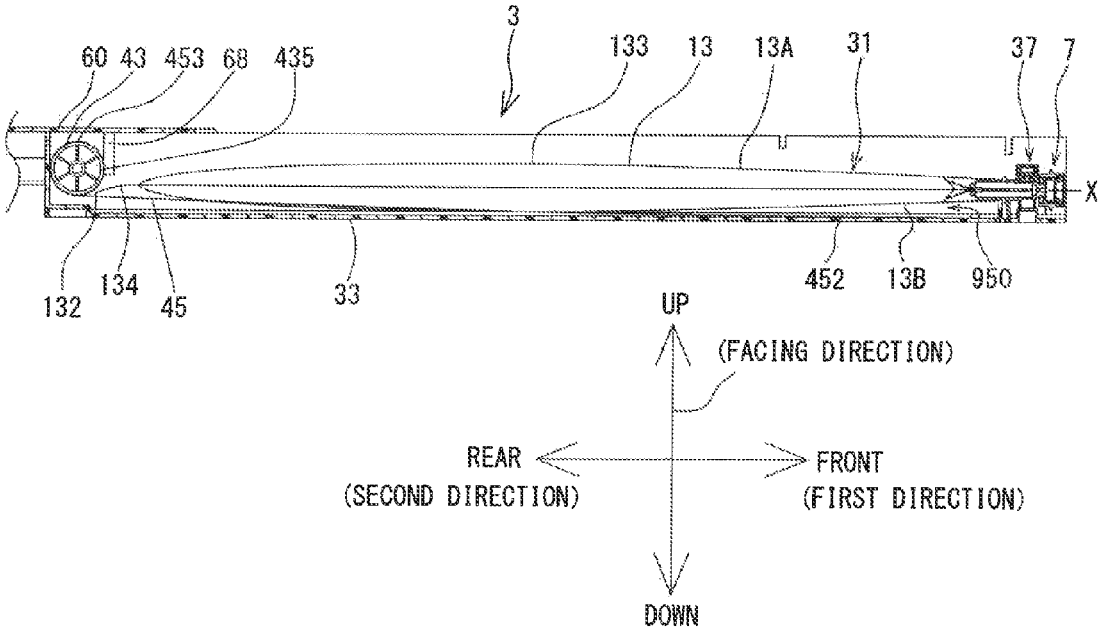
FIG. 23C is a cross-sectional view and is a continuation of FIG. 23B.

The operator grasps the plug 7 of the liquid storage body 31. The second plug protruding portion 85 elastically deforms on the plug 7 side. As shown in FIG. 23C, the operator arranges the liquid storage body 31 in the first case 33 from above the first case 33. At that time, the first plug protruding portion 83 protrudes downward from the first open portion 372. The lower end portion of the first plug protruding portion 83 is positioned inside the groove portion 362 (refer to FIG. 13). The first engagement tab 834 of the first plug protruding portion 83 engages with the groove portion 362 on the first outer surface 345 side. The first support portion 346 and the second support portion 347 support the bottom surface of the plug 7. The second engagement tab 856 of the second plug protruding portion 85 engages with the second open portion 391 (refer to FIG. 9). The second plug protruding portion 85 engages with the second open portion 391 in an elastically deformed state. The plug support portion 37 supports the plug 7 in this way.

As shown in FIG. 23C, in the facing direction, a center position (a position shown on the X-axis line) of the plug 7 supported by the plug support portion 37 is positioned above (on the second inner surface 644 side of) a lower end portion 452 (the first inner surface 344 side) of the elastic member 45 (refer to FIG. 11). In other words, the center position of the plug 7 is positioned between an upper end portion 453 and the lower end portion 452 of the elastic member 45. The upper end portion 453 is the upper end of the elastic member 45 which is taken up on the shaft portion 43. The lower end portion 452 (refer to FIG. 15C) is a portion of the elastic member 45 that is in contact with the first inner surface 344 (refer to FIG. 8). The center position of the plug 7 is the same position as the center of the hollow portion 712 (refer to FIG. 7).

The liquid storage bag 13 is positioned on the upper surface side of the support wall portion 34 and the elastic member 45. The end portion 435 on the first direction side of the shaft portion 43 that is in the first position is positioned further to the first direction side than the second end portion 132 on the second direction side of the liquid storage bag 13.

Figure 23D:
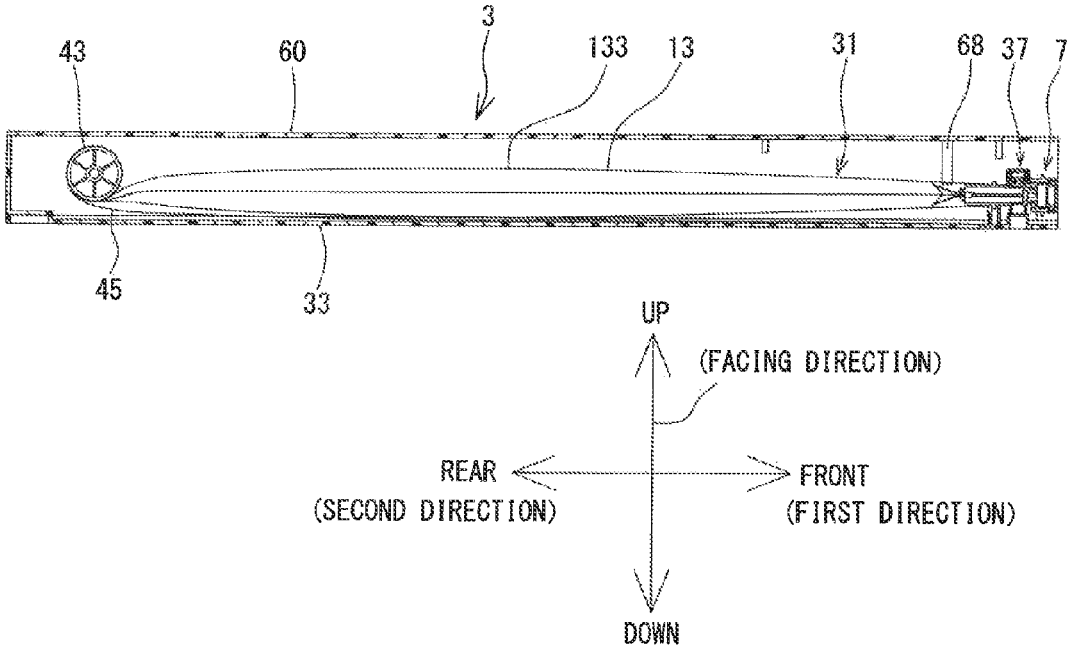
FIG. 23D is a cross-sectional view and is a continuation of FIG. 23C.

As shown in FIG. 23D, the operator moves the second case 60 in the first direction with respect to the second case 33, and closes the second case 60 that forms the lid of the case 32. With the moving of the second case 60 in the first direction, the pressing wall portions 67 and 68 move in the first direction. Pressing from the pressing wall portions 67 and 68 to the shaft portion 43 is released. Therefore, due to the urging force of the elastic member 45, the shaft portion 43 moves in the first direction while rotating in the clockwise direction in a left side view. The elastic member 45 is wound in the clockwise direction in a left side view. The shaft portion 43 takes up the liquid storage bag 13 from the second end portion 132 on the second direction side toward the first direction side. As the extension portion 134 is a flat region in which no ink is stored, the shaft portion 43 easily takes up the extension portion 134. The shaft portion 43 starts taking up the liquid storage portion 133 from the extension portion 134. At the time of taking up of the liquid storage portion 133 by the shaft portion 43, the shaft portion 43 pushes the ink inside the liquid storage portion 133 in the first direction toward the plug 7. The movement of the shaft portion 43 stops at a position at which the force causing the shaft portion 43 to move in the first direction due to the urging force of the elastic member 45 becomes equal to a force with which the liquid storage portion 133 pushes the shaft portion 43 in the second direction. The operator acquires a completed unit of the cartridge 3, in which the new liquid storage body 31 is mounted in the case 32. In the meantime, as shown in FIG. 13, each of the pressing wall portions 67 and 68 is respectively located at the end portion in the orthogonal direction of the second case 60. Therefore, the pressing wall portions 67 and 68 do not interfere with the liquid storage portion 133 when the pressing wall portions 67 and 68 move toward the first direction.

The operator pushes the cartridge 3 into the open portion 120 from the front end side of the cartridge 3, and thus mounts the cartridge 3 in the cartridge mounting portion 8 (refer to FIG. 2). As described above, the hollow needle pierces the rubber plug that is provided in the plug 7 of the liquid storage body 31 stored in the cartridge 3, in order to lead out the liquid from the liquid storage body 31.

Further, as shown in FIG. 19, the optical detection portions 921 and 922 are arranged in the vicinity of the first display portion 473 and the second display portion 483 of the detection portion 46. The protruding end portion 432 of the shaft portion 43 is positioned further to the second direction side than the first side plate portion 47 and the second side plate portion 48. Thus, the detection portion 46 is in the first state in which the first display portion 473 is in the lower position due to the urging force of the coil spring 461, and the second display portion 483 is in the upper position. In this case, the light of the light emitting portion 923 of the optical detection portion 921 is blocked by the second display protruding portion 473B of the first display portion 473 and the light receiving portion does not receive the light. Further, the light of the light emitting portion 924 of the optical detection portion 922 passes below the second display portion 483 and the light receiving portion receives the light. Thus, the combination of the output values of the optical detection portions 921 and 922 is "0", "1". The CPU of the printer 1 can detect the output values of the optical detection portions 921 and 922 and detect the remaining amount of ink in the liquid storage body 31.

At a time of a printing operation, the ink inside the liquid storage portion 133 flows out to the outside of the liquid storage body 31 via the hollow needle. The ink flowing outside of the liquid storage body 31 flows to each of the nozzles. The nozzles of the printer 1 discharge the ink. As shown in FIG. 24A to FIG. 24D, along with the leading out of the ink from the liquid storage body 31, the shaft portion 43 moves in the first direction while taking up the liquid storage portion 133 as a result of the urging force of the elastic member 45.

Figure 20:
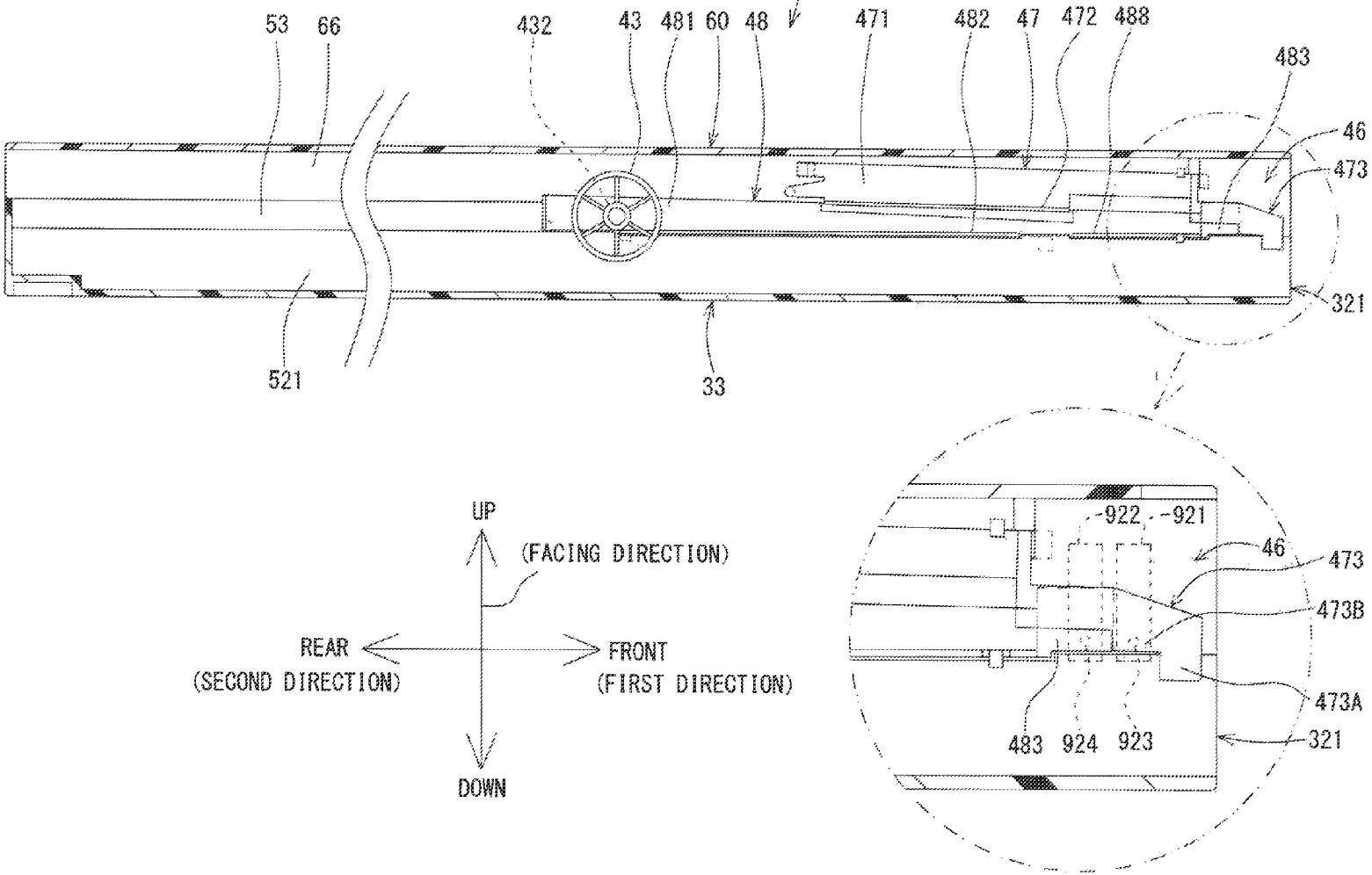
FIG. 20 is a cross-sectional view along the line B-B shown in FIG. 3, when the first display portion and the second display portion are in a second state.

The shaft portion 43 moves as far as a first intermediate position (refer to FIG. 20 and FIG. 24A) in which the protruding end portion 432 is in contact with the upper surface of the second contact portion 482 of the second side plate portion 48. As shown in FIG. 20, the second contact portion 482 is pressed downward by the protruding end portion 432. Thus the second display portion 483 of the second side plate portion 48 rotates in the clockwise direction in a left side view, against the urging force of the coil spring 461. As a result, the detection portion 46 is in the second state in which the first display portion 473 is in the lower position and the second display portion 483 is in the lower position. In this case, the light of the light emitting portion 923 of the optical detection portion 921 is blocked by the second display protruding portion 473B of the first display portion 473 and the light receiving portion does not receive the light. Further, the light of the light emitting portion 924 of the optical detection portion 922 is blocked by the second display portion 483, and the light receiving portion does not receive the light. Thus, the combination of the output values of the optical detection portions 921 and 922 is "0", "0". The CPU of the printer 1 can detect the output values of the optical detection portions 921 and 922 and detect the remaining amount of ink in the liquid storage body 31.

When the ink is further discharged as a result of the printing operation, the shaft portion 43 moves as far as a second intermediate position (refer to FIG. 21 and FIG. 24B) in which the protruding end portion 432 comes into contact with the upper surface of the second contact portion 482 and the lower surface of the first contact portion 472. As shown in FIG. 21, the first contact portion 472 is pressed upward by the protruding end portion 432. Thus the first display portion 473 of the first side plate portion 47 moves upward along the facing direction or, more precisely, rotates in the clockwise direction in the left side view, against the urging force of the coil spring 461. As a result, the detection portion 46 is in the third state in which the first display portion 473 is in the upper position and the second display portion 483 is in the lower position. In this case, the light of the light emitting portion 923 of the optical detection portion 921 passes below the second display protruding portion 473B of the first display portion 473 and the light receiving portion receives the light. Further, the light of the light emitting portion 924 of the optical detection portion 922 is blocked by the second display portion 483, and the light receiving portion does not receive the light. Thus, the combination of the output values of the optical detection portions 921 and 922 is "1", "0". The CPU of the printer 1 can detect the output values of the optical detection portions 921 and 922 and detect the remaining amount of ink in the liquid storage body 31.

When the ink is further discharged as a result of the printing operation, the shaft portion 43 moves as far as a third intermediate position (refer to FIG. 22 and FIG. 24C) in which the protruding end portion 432 is between the second contact portion 482 and the protruding portion 488 and is in contact with the lower surface of the first contact portion 472. As shown in FIG. 22, the protruding end portion 432 is in contact with neither the second contact portion 482 nor the protruding portion 488 and, due to the urging force of the coil spring 461, the second display portion 483 of the second side plate portion 48 rotates in the anticlockwise direction in the left side view. As a result, the detection portion 46 is in the fourth state in which the first display portion 473 is in the upper position and the second display portion 483 is in the upper position. In this case, the light of the light emitting portion 923 of the optical detection portion 921 passes below the second display protruding portion 473B of the first display portion 473 and the light receiving portion receives the light. Further, the light of the light emitting portion 924 of the optical detection portion 922 passes below the second display portion 483, and the light receiving portion receives the light. Thus, the combination of the output values of the optical detection portions 921 and 922 is "1", "1". The CPU of the printer 1 can detect the output values of the optical detection portions 921 and 922 and detect the remaining amount of ink in the liquid storage body 31. The CPU performs a display, for example, that prompts the operator to replace the liquid storage body 31.

Figure 24A:
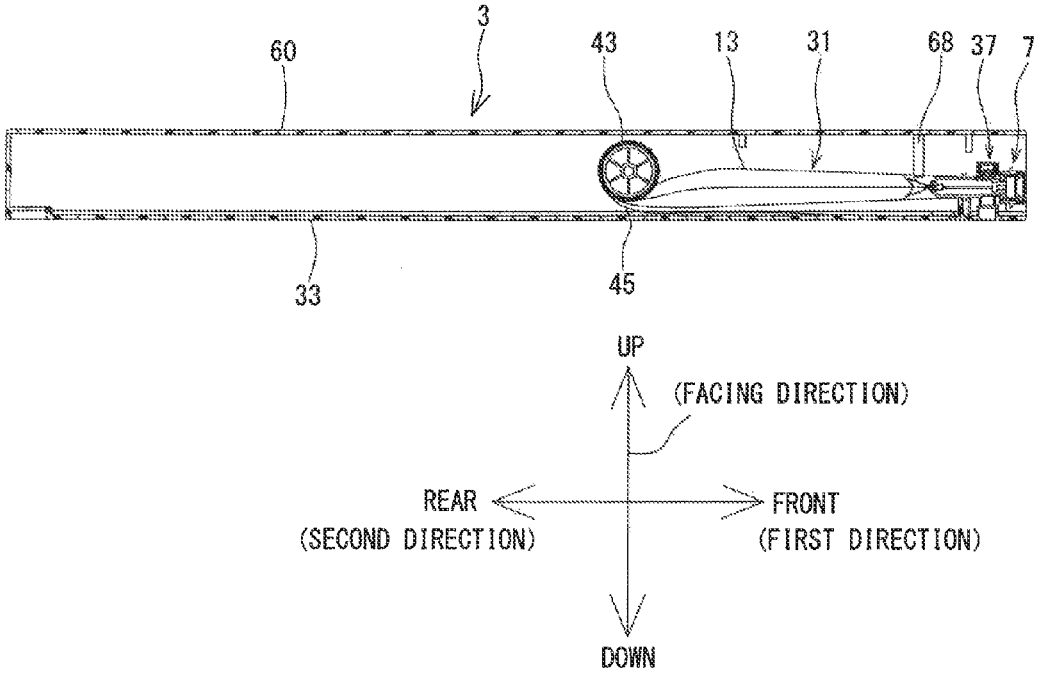
FIG. 24A is a cross-sectional view and is a continuation of FIG. 23D.
Figure 24B:
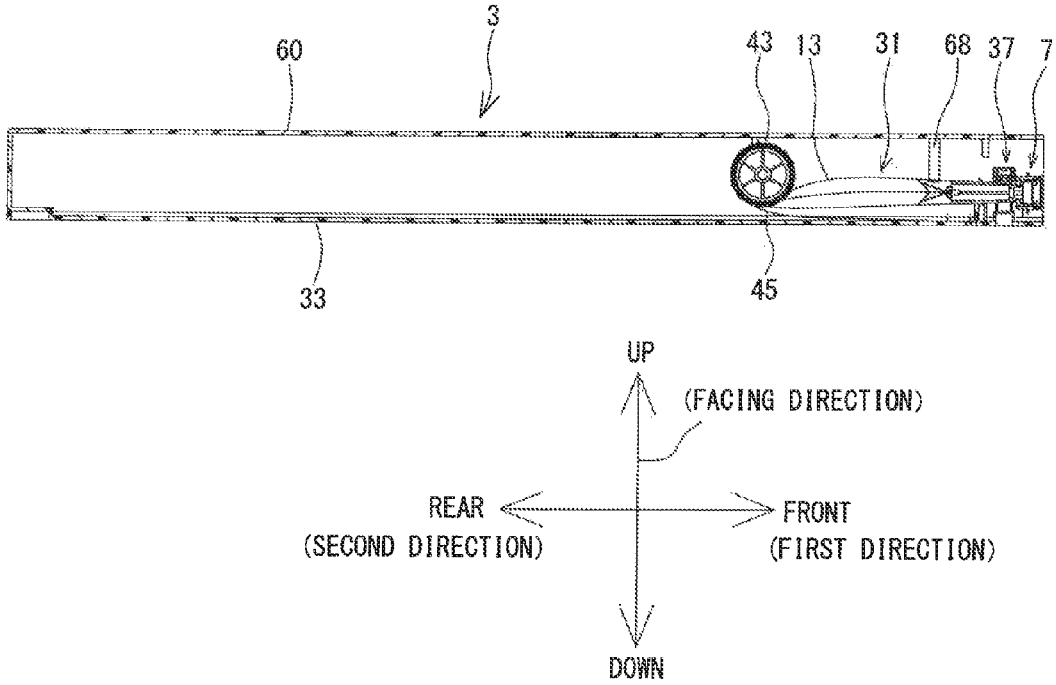
FIG. 24B is a cross-sectional view and is a continuation of FIG. 24A.
Figure 24C:
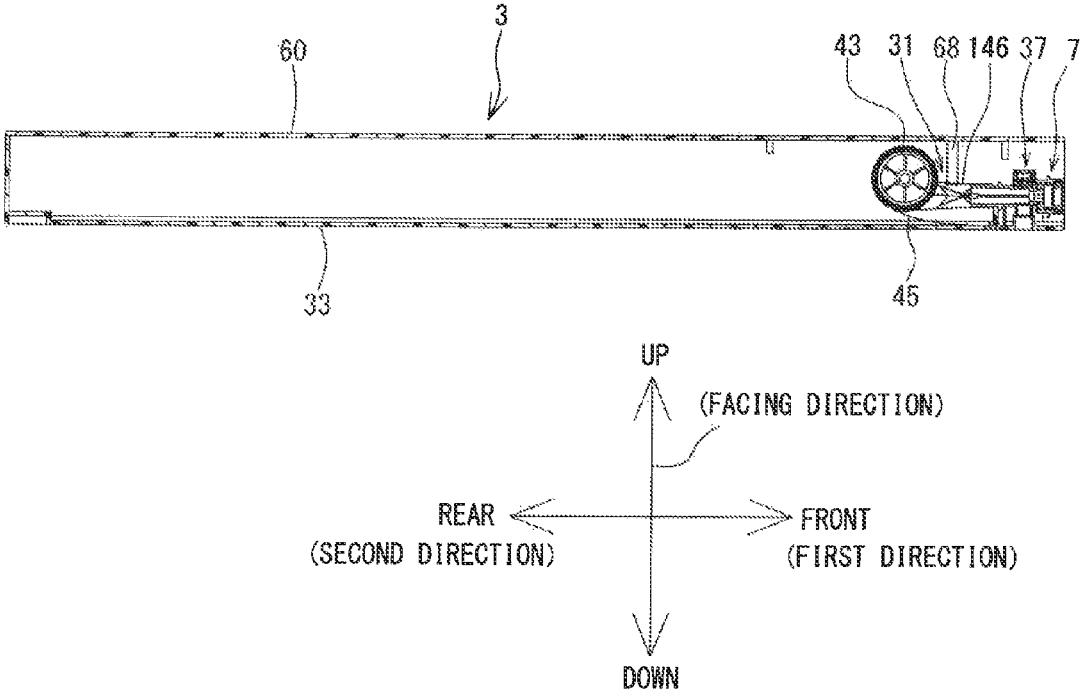
FIG. 24C is a cross-sectional view and is a continuation of FIG. 24B.

As shown in FIG. 24C, the shaft portion 43 moves as far as the curved area 146 of the liquid storage bag 13. As described above, in the curved area 146, the sheets 13A and 13B are curved in a direction to separate from each other (in the up-down direction) along the insertion portion 76 (refer to FIG. 5). Thus, it is harder to take up the curved area 146 than a portion further to the second direction side of the curved area 146. Therefore, the movement of the shaft portion 43 stops at the curved area 146. A position at which the shaft portion 43 has stopped is an end position of the movement of the shaft portion 43. In the present embodiment, the end position of the movement of the shaft portion 43 is the same as the third intermediate position shown in FIG. 24C. However, the end position of the movement of the shaft portion 43 may be further to the first direction side than the third intermediate position.

Figure 24D:
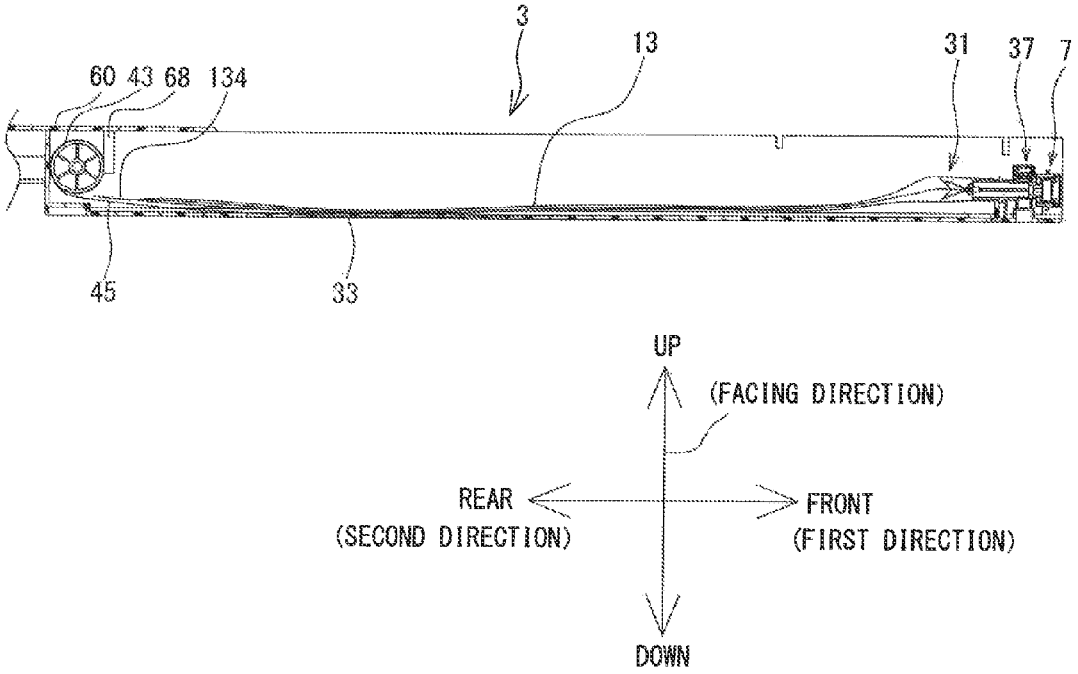
FIG. 24D is a cross-sectional view and is a continuation of FIG. 24C.

The operator removes the cartridge 3 from the cartridge mounting portion 8 and replaces the liquid storage body 31 after the ink has been led out. When the operator moves the second case 60 in the second direction with respect to the first case 33, the pressing wall portions 67 and 68 resist the urging force of the elastic member 45 and move the shaft portion 43, which has taken up the liquid storage bag 13, in the second direction. As a result, as shown in FIG. 24D, the liquid storage bag 13 is apart from the shaft portion 43. The operator removes the liquid storage body 31 after the ink has been led out, and mounts the new liquid storage bag 13 in the case 32, as shown in FIG. 23B and FIG. 23C.

Thus, the cartridge 3 using the case 32 can be easily assembled.

Further, as shown in FIG. 19 to FIG. 22, the shaft portion 43 that is urged in the first direction by the elastic member 45 is provided in the case 32, and it is thus possible to wind the liquid storage bag 13 on the shaft portion 43. As the remaining amount of ink inside the liquid storage bag 13 decreases, the shaft portion 43 moves in the first direction. Further, the first contact portion 472 and the second contact portion 482, which are installed in different states from each other in the first direction, are arranged on the movement path 53 of the protruding end portion 432. Thus, depending on the position of the protruding end portion 432 in the first direction, states of contact between the protruding end portion 432 that moves in the first direction and the first contact portion 472 and the second contact portion 482 change, and positions of the first display portion 473 and the second display portion 483 in the facing direction thus also change. As a result, the case 32 can display the remaining amount of ink inside the liquid storage bag 13, using the first display portion 473 and the second display portion 483 that are exposed to the outside via the end open portion 321. Therefore, the operator can verify the remaining amount of ink inside the liquid storage bag 13 by visually checking the positions in the facing direction of the first display portion 473 and the second display portion 483, from the end open portion 321 of the cartridge 3 that has been removed from the cartridge mounting portion 8. Further, the case 32 can output, to the outside, a signal relating to the remaining amount of ink, by using the optical detection portions 921 and 922 and thus detecting the positions in the facing direction of the first display portion 473 and the second display portion 483.

As shown in FIG. 14, the first display portion 473 is positioned on the inside in the orthogonal direction of the first arm portion 471. Similarly, the second display portion 483 is positioned on the inside in the orthogonal direction of the second arm portion 481. Therefore, the first display portion 473 and the second display portion 483 are arranged such that they are separated from the side wall 52 and the side wall 62 (refer to FIG. 8). Thus, in comparison to a case in which the first display portion 473 and the second display portion 483 are in contact with the side wall 52 or the side wall 62 of the case 32, it becomes easy for the operator to visually check the first display portion 473 and the second display portion 483 and the remaining amount of ink can thus be easily verified. Further, in comparison to the case in which the first display portion 473 and the second display portion 483 are in contact with the side wall 52 or the side wall 62 of the case 32, it is easy to arrange the optical detection portions 921 and 922.

The first contact portion 472 protrudes to the left, which is the inside in the orthogonal direction, from a portion of the first arm portion 471 in the facing direction. Similarly, the second contact portion 482 protrudes to the left, which is the inside in the orthogonal direction, from a portion of the second arm portion 481 in the facing direction. In this case, lengths of the first arm portion 471 and the second arm portion 481 are respectively longer than lengths of the first contact portion 472 and the second contact portion 482 in the facing direction. Thus, in this case, in comparison to a case in which only the first contact portion 472 and the second contact portion 482 are provided, strength is improved. If the first side plate portion 47 and the second side plate portion 48 are damaged, it is possible that the first display portion 473 and the second display portion 483 may not be able to display the remaining amount of ink inside the liquid storage bag 13. The present embodiment can reduce that possibility.

For example, in a case in which the coil spring 461 is not provided and the first display portion 473 and the second display portion 483 move along the facing direction due to gravitational force, the movement force is weaker in comparison to the case in which the coil spring 461 is provided, and it is possible that it may become difficult for the first display portion 473 and the second display portion 483 to move. In the present embodiment, the coil spring 461 (refer to FIG. 8) urges the first side plate portion 47 and the second side plate portion 48 and, in comparison to the case in which the coil spring 461 is not provided, the positions of the first display portion 473 and the second display portion 483 are more stable. As a result, the case 32 can accurately display the remaining amount of ink inside the liquid storage bag 13, using the first display portion 473 and the second display portion 483.

In addition, in the present embodiment, the first side plate portion 47 is arranged in the case 32 by the first support open portions 541 and 542 being engaged with the first side plate engagement portions 474 and 475, and it is possible to display the remaining amount of ink inside the liquid storage bag 13. Further, the second side plate portion 48 is arranged in the case 32 by the second support open portions 551 and 552 being engaged with the second side plate engagement portions 484 and 485, and it is possible to display the remaining amount of ink inside the liquid storage bag 13.

Furthermore, as shown in FIG. 19, the first contact portion 472 and the second contact portion 482 are arranged in an inclined manner with respect to the movement path 53 of the protruding end portion 432. As a result, in comparison to a case in which the first contact portion 472 and the second contact portion 482 are formed in a stepped shape, the first display portion 473 and the second display portion 483 move smoothly along the facing direction in accordance with the movement of the protruding end portion 432.

The present disclosure is not limited to the above-described embodiment and various modification can be made to the above-described embodiment.

In the above-described embodiment, the first contact portion 472 and the second contact portion 482 are arranged in an inclined manner with respect to the movement path 53 of the protruding end portion 432, but the present disclosure is not limited to this example. For example, the first contact portion 472 and the second contact portion 482 may be arranged in a stepped shape on the movement path 53. Further, two of the first support open portions 541 and 542, the first side plate engagement portions 474 and 475, the second support open portions 551 and 552 and the second side plate engagement portions 484 and 485 are provided, respectively, but as long as at least two of each of the members are provided, three or more may be provided. In addition, the first side plate portion 47 is supported by the first support open portions 541 and 542 such that the first display portion 473 can move along the facing direction, but the first side plate portion 47 may be supported using another structure. The second side plate portion 48 is supported by the second support open portions 551 and 552 such that the second display portion 483 can move in the facing direction, but the second side plate portion 48 may be supported using another structure. For example, open portions may be provided in the first side plate portion 47 and the second side plate portion 48 and engagement portions that engage with the open portions may protrude from the side wall 52. In addition, the coil spring 461 need not necessarily be provided.

Further, the first contact portion 472 and the second contact portion 482 protrude, respectively, from a portion of the first arm portion 471 and a portion of the second arm portion 481. However, the first contact portion 472 and the second contact portion 482 may protrude from the whole of the first arm portion 471 and the whole of the second arm portion 481, respectively. In addition, the first arm portion 471 and the second arm portion 481 need not necessarily be provided, and only the first contact portion 472 and the second contact portion 482 may be provided. In this case, the first display portion 473 and the second display portion 483 may be connected to the first contact portion 472 and the second contact portion 482, respectively.

Furthermore, the first display portion 473 and the second display portion 483 are arranged such that they are separated from the side walls 52 and 62. However, the first display portion 473 and the second display portion 483 may be in contact with the side walls 52 and 62. Further, the two side plates, namely, the first side plate portion 47 and the second side plate portion 48, are provided in the above description, but a number of the side plates is not limited. The number of the side plates may be one, or may be three or more. Further, the first display portion 473 and the second display portion 483 have a predetermined shape, but they may have a predetermined pattern. In this case, the operator can verify the remaining amount of ink by verifying the pattern of the first display portion 473 and the second display portion 483 whose positions change in the facing direction in accordance with the remaining amount of ink. Further, the optical detection portions 921 and 922 may be structured to detect an amount of reflected light from the first display portion 473 and the second display portion 483, and the CPU may detect the remaining amount of ink by detecting the amount of light that changes depending on the position of the pattern.

Figure 25:
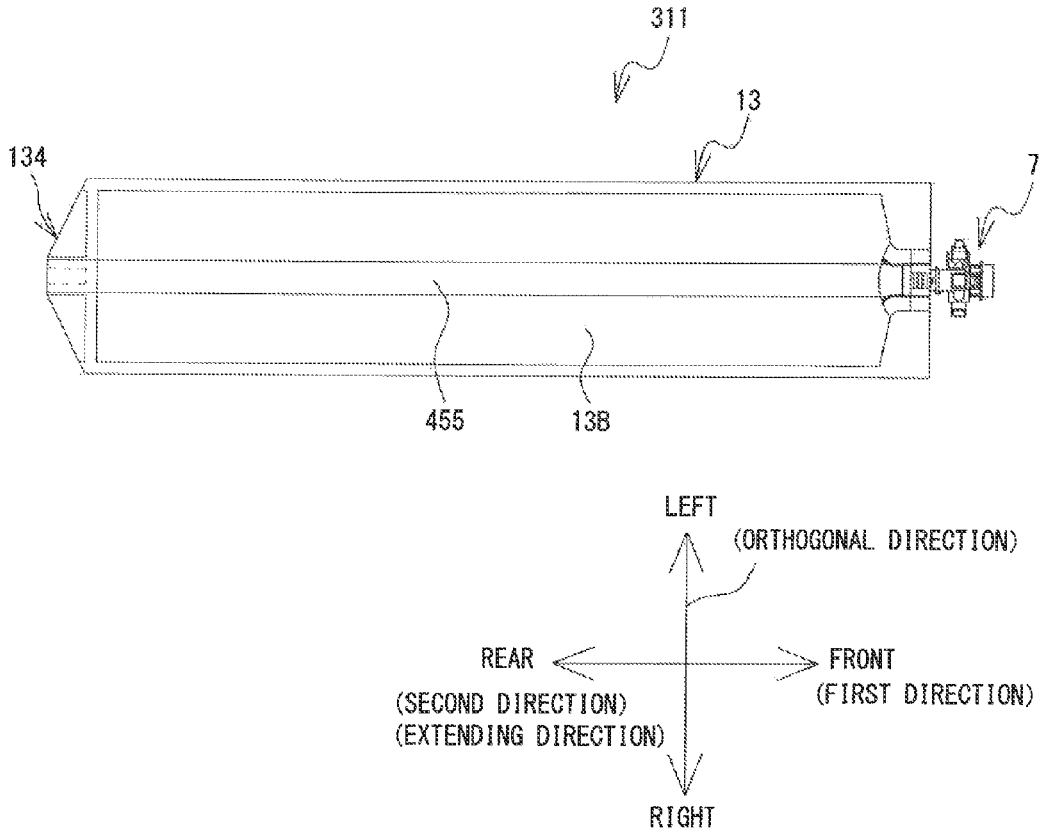
FIG. 25 is a bottom view of a liquid storage body of a modified example.

The structure in which the elastic member 45 is provided inside the case 32 is not essential. For example, as shown in FIG. 25, an elastic member 455 may be adhered to a center portion in the orthogonal direction of the sheet 13B on the bottom surface side of the liquid storage bag 13. The elastic member 455 extends in the second direction (the extending direction) from the second direction side of the plug 7 that is provided on the end portion on the first direction side. The end portion on the second direction side of the elastic member 455 is positioned in the extension portion 134. When a liquid storage body 311 is used, the mounting portion 336 (refer to FIG. 10) and the elastic member 45 (refer to FIG. 8) need not necessarily be provided in the first case 33. By placing the liquid storage body 311 in the case 32 that is not provided with the elastic member 45, and winding the end portion on the second direction side of the elastic member 455 around the shaft portion 43 along with the extension portion 134, it is possible to take up the liquid storage bag 13 in a similar manner to the cases shown in FIG. 23A to FIG. 23D and FIG. 24A to FIG. 24D and then to push liquid in the liquid storage portion 133 out to the plug 7.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cartridge case that supports a bag storing a liquid, the cartridge case comprising:

a case main body which includes a first side wall and a second side wall that extend in a first direction and that face each other, and which has an end open portion that is an open portion between end portions in the first direction of each of the first side wall and the second side wall;

a shaft portion that is arranged to take up an elastic member from an end portion on a second direction side of the elastic member and to move in the first direction in accordance with a liquid storage amount in the bag, the elastic member generating a restoring force in the first direction by being extended in the second direction, the second direction being a direction opposite to the first direction, the shaft portion extending in a third direction that is a direction in which the first side wall and the second side wall face each other and that is orthogonal to the first direction, and the shaft portion having a first protruding end portion and a second protruding end portion, the first protruding portion protruding in the third direction from one end in the third direction of the shaft portion, the second protruding portion protruding in the third direction from another end in the third direction of the shaft portion;

a first side plate portion arranged inside the case main body on a first direction side and on an end portion on the first side wall side, the first side plate having a first arm portion, a first contact portion and a first display portion;

the first arm portion extending in the first direction and supported by the first side wall such that the first arm portion can move along a fourth direction, the fourth direction being a direction that is orthogonal to the first direction and orthogonal to the third direction;

the first contact portion provided on the first arm portion and arranged on a movement path of the first protruding end portion such that the first contact portion is configured to contact with the first protruding end portion that moves in the first direction;

the first display portion provided in a fixed manner with respect to an end portion in the first direction of the first arm portion such that the first display portion moves along the fourth direction in accordance with the movement of the first arm portion;

a second side plate portion arranged inside the case main body on the first direction side and on the end portion on the first side wall side, the second side plate having a second arm portion, a second contact portion and a second display portion;

the second arm portion extending in the first direction and supported by the first side wall such that the second arm portion can move along the fourth direction;

the second contact portion provided on the second arm portion and arranged on the movement path of the first protruding end portion such that the second contact portion is configured to contact with the first protruding end portion that moves in the first direction;

the second display portion provided in a fixed manner with respect to an end portion in the first direction of the second arm portion such that the second display portion moves along the fourth direction in accordance with the movement of the second arm portion; and an end in the first direction of the first contact portion being located at a different position from an end in the first direction of the second contact portion.

2. The cartridge case according to claim 1, wherein the first display portion is located between the first arm portion and the second side wall in the third direction, and wherein the second display portion is located between the second arm portion and the second side wall in the third direction.

3. The cartridge case according to claim 1, wherein the first contact portion protrudes from the first arm portion toward the second side wall in the third direction, and wherein the second contact portion protrudes from the second arm portion toward the second side wall in the third direction.

4. The cartridge case according to claim 1, further comprising an urging member that urges the first and second arm portions in the fourth direction.

5. The cartridge case according to claim 1, wherein the first side wall has at least two support open portions that are open portions extending in the fourth direction and that are arranged to be separated from each other in the first direction, and the first side plate portion or the second side plate portion includes side plate engagement portions that engage with the at least two support open portions.

6. The cartridge case according to claim 1, wherein each of the first and second contact portions is arranged in an inclined manner with respect to the movement path of the protruding end portion, and wherein the first and second contact portions are arranged facing with each other in the fourth direction such that a gap in the fourth direction between the first and second contact portions becomes smaller as going toward the first direction while the first protruding end portion is not in contact with the first and second contact portions.

7. The cartridge case according to claim 1, further comprising a mounting portion provided on an end portion on the first direction side of the case main body and configured such that an end portion on the first direction side of the elastic member is able to be mounted on the mounting portion, wherein the cartridge case is configured such that the bag is able to be inserted into and removed from the cartridge case in a state in which the elastic member is mounted on the mounting portion.

8. The cartridge case according to claim 1, wherein the cartridge case is configured such that a liquid storage body is able to be inserted into and removed from the cartridge case, the liquid storage body including the bag and the elastic member that is integrated with the bag.

9. The cartridge case according to claim 1, wherein the end in the first direction of the first contact portion is located on the first direction side from the end in the first direction of the second contact portion.

10. The cartridge case according to claim 1, wherein an end in the second direction of the first contact portion is located on the second direction side from the end in the first direction of the second contact portion.

11. The cartridge case according to claim 1, wherein the end in the second direction of the first contact portion is located on the first direction side from an end in the second direction of the second contact portion.

12. The cartridge case according to claim 1, wherein the first protruding end portion is configured to contact with the first contact portion on one side of the fourth direction and contacts with the second contact portion on another side of the fourth direction.

13. The cartridge case according to claim 12, wherein the first side wall and the second side wall extend from a support wall portion toward the one side of the fourth direction, the support wall portion extending in the first direction and the third direction.

14. A cartridge case that supports a bag storing a liquid, the cartridge case comprising:

a case main body which includes a first side wall and a second side wall that extend in a first direction and that face each other, and which has an end open portion that is an open portion between end portions in the first direction of each of the first side wall and the second side wall;

a shaft portion that is arranged to take up an elastic member from an end portion on a second direction side of the elastic member and to move in the first direction in accordance with a liquid storage amount in the bag, the elastic member generating a restoring force in the first direction by being extended in the second direction, the second direction being a direction opposite to the first direction, the shaft portion extending in a third direction that is a direction in which the first side wall and the second side wall face each other and that is orthogonal to the first direction, and the shaft portion having a first protruding end portion and a second protruding end portion, the first protruding portion protruding in the third direction from one end in the third direction of the shaft portion, the second protruding portion protruding in the third direction from another end in the third direction of the shaft portion;

a first side plate portion arranged inside the case main body on a first direction side and on an end portion on the first side wall side, the first side plate having a first arm portion, a first contact portion and a first display portion;

the first arm portion extending in the first direction and supported by the first side wall such that the first arm portion can move along a fourth direction, the fourth direction being a direction that is orthogonal to the first direction and orthogonal to the third direction;

the first contact portion provided on the first arm portion and arranged on a movement path of the first protruding end portion such that the first contact portion is configured to contact with the first protruding end portion that moves in the first direction;

the first display portion provided in a fixed manner with respect to an end portion in the first direction of the first arm portion such that the first display portion moves along the fourth direction in accordance with the movement of the first arm portion;

a second side plate portion arranged inside the case main body on the first direction side and on the end portion on the first side wall side, the second side plate having a second arm portion, a second contact portion and a second display portion;

the second arm portion extending in the first direction and supported by the first side wall such that the second arm portion can move along the fourth direction;

the second contact portion provided on the second arm portion and arranged on the movement path of the first protruding end portion such that the second contact portion is configured to contact with the first protruding end portion that moves in the first direction;

the second display portion provided in a fixed manner with respect to an end portion in the first direction of the second arm portion such that the second display portion moves along the fourth direction in accordance with the movement of the second arm portion; and an end in the second direction of the first contact portion being located at a different position from an end in the second direction of the second contact portion.

15. The cartridge case according to claim 14, wherein the end in the second direction of the first contact portion is located on the first direction side from the end in the second direction of the second contact portion.

16. The cartridge case according to claim 14, wherein the end in the second direction of the first contact portion is located on the second direction side from an end in the first direction of the second contact portion.

17. The cartridge case according to claim 14, wherein the first contact portion protrudes from the first arm portion toward the second side wall in the third direction, and wherein the second contact portion protrudes from the second arm portion toward the second side wall in the third direction.

18. The cartridge case according to claim 14, wherein each of the first and second contact portions is arranged in an inclined manner with respect to the movement path of the protruding end portion, and wherein the first and second contact portions are arranged facing with each other in the fourth direction such that a gap in the fourth direction between the first and second contact portions becomes smaller as going toward the first direction while the first protruding end portion is not in contact with the first and second contact portions.

19. The cartridge case according to claim 14, further comprising an urging member that urges the first and second arm portions in the fourth direction.

20. The cartridge case according to claim 14, wherein the first protruding end portion is configured to contact with the first contact portion on one side of the fourth direction and contacts with the second contact portion on another side of the fourth direction.

21. The cartridge case according to claim 20, wherein the first side wall and the second side wall extend from a support wall portion toward the one side of the fourth direction, the support wall portion extending in the first direction and the third direction.

* * * * *